US006913486B2

(12) United States Patent
Nagayasu et al.

(10) Patent No.: US 6,913,486 B2
(45) Date of Patent: Jul. 5, 2005

(54) WATERPROOF ELECTRICAL CONNECTOR

(75) Inventors: Daiki Nagayasu, Yokkaichi (JP); Kimikazu Itou, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/700,826

(22) Filed: Nov. 5, 2003

(65) Prior Publication Data

US 2004/0092163 A1 May 13, 2004

(30) Foreign Application Priority Data

Nov. 7, 2002 (JP) ..... 2002-323400
Nov. 7, 2002 (JP) ..... 2002-324314
Nov. 8, 2002 (JP) ..... 2002-325202

(51) Int. Cl.[7] ..... H01R 13/40
(52) U.S. Cl. ..... 439/587
(58) Field of Search ..... 439/275, 587

(56) References Cited

U.S. PATENT DOCUMENTS 5,569,051 A * 10/1996 Endo et al. ..... 439/587
5,613,868 A * 3/1997 Ohsumi et al. ..... 439/275
5,632,653 A * 5/1997 Sawada ..... 439/587
5,679,019 A * 10/1997 Sakai et al. ..... 439/275
5,931,699 A * 8/1999 Saito ..... 439/587
6,217,394 B1 * 4/2001 Sugie ..... 439/752.5
D459,310 S 6/2002 Tanaka
6,450,823 B1 9/2002 Ichio et al.
6,527,586 B2 * 3/2003 Okamura et al. ..... 439/587
6,626,702 B2 9/2003 Kurimoto et al.
2002/0052142 A1 5/2002 Ishikawa et al.

FOREIGN PATENT DOCUMENTS

JP 124336 4/2002

OTHER PUBLICATIONS

English Language abstract JP 2002–124336.

* cited by examiner

*Primary Examiner*—Thanh-Tam Le
(74) *Attorney, Agent, or Firm*—Greenblum & Bernstein, P.L.C.

(57) ABSTRACT

A waterproof electrical connector is provided in which terminal chambers are provided in a base housing, thru-holes are formed in a flexible plug, which is inserted into an internal space of the base housing, and ribs are provided on the perimeter of the flexible plug. A channel, which is formed in an insertion face of the flexible plug between the outer perimeter of the flexible plug and outermost thru-holes, is able to absorb the compression applied to the circumference of the insertion side of the flexible plug, and thus maintain the alignment of the thru-holes with terminal chambers.

6 Claims, 20 Drawing Sheets

WATERPROOF ELECTRICAL CONNECTOR

BACKGROUND OF THE INVENTION

1. Field of the Invention

This invention relates to a waterproof electrical connector, specifically, a waterproof electrical connector in which misalignment between thru-holes formed in a flexible plug and wire terminal chambers, or between thru-holes formed in a flexible plug and thru-holes formed in an inner housing can be prevented even though a compressive force distorts the flexible plug.

2. Description of Related Art

A conventional waterproof electrical connector typically employs a single-piece flexible sealing component as means of waterproofing multiple wire passages in the connector (see Japanese Laid-Open Patent No. 2002-124336). As shown in FIG. 20A, waterproof connector 1 has base housing 2 which includes multiple terminal chambers 2*a*, and perimeter wall 2*b* that encloses internal space 2*c*, perimeter wall 2*b* being located at the rear surface of base housing 2. Flexible plug 3 includes flexible ribs 3*a* formed at the external surface thereon, and installed within internal space 2*c* with flexible ribs 3*a* being compressed against the inner surfaces of the walls that define internal space 2*c*. Flexible plug 3 includes thru-holes 3*b* that corresponds to the positions of terminal chambers 2*a*. Wire terminal T, which is attached to the end of each wire passing through each thru-hole 3*b*, is inserted into each terminal chamber 2*a*. Wires W are waterproofed by means of the inner surfaces of each thru-hole 3*b* in flexible plug 3 maintaining flexible pressurized contact with the external surface of each wire W. Rear cover 4 is installed at the rearward end of perimeter wall 2*b* to secure flexible plug 3 within internal space 2*c*.

The above-noted prior art structure exhibits a specific shortcoming. As illustrated in FIG. 20B, flexible plug 3 is subject to constrictive pressure applied by the internal surfaces of the wall that defines internal space 2*c* in the connector housing when flexible plug 3 is inserted therein. This constrictive pressure has the effect of positionally displacing thru-holes 3*b* toward the center of the connector, a phenomenon which is especially pronounced for the thru-holes located closest to the perimeter of flexible plug 3. As a result, thru-holes 3*b* do not align accurately with terminal chambers 2*a*. When this misalignment is present, the insertion of a wire terminal T into a terminal chamber 2*a*, via thru-hole 3*b*, may result in the tip of wire terminal T being damaged through contact with a wall delineating a terminal chamber 2*a*.

SUMMARY OF THE INVENTION

The invention, having considered the aforesaid shortcoming, puts forth a structure for a waterproof electrical connector in which the aforesaid misalignment between the flexible plug thru-hole and corresponding terminal chamber is substantially reduced, despite the constrictive pressure applied to the flexible plug when inserted into the connector housing.

In order to solve the aforesaid shortcoming in the prior art structure, the present invention provides a waterproof electrical connector including a base housing that has a plurality of terminal chambers and an internal space defined by a perimeter wall located behind the plurality of terminal chambers, a rear cover that is configured to engage with the base housing to seal the internal space, a flexible plug that extends from an inner surface of the rear cover, the flexible plug being configured to be inserted into the internal space, and ribs that are formed on an outer peripheral surface of the flexible plug. The rear cover has a plurality of thru-holes, and the flexible plug has a plurality of thru-holes. The rear cover thru-holes and the flexible plug thru-holes are configured to concentrically align with the plurality of terminal chambers. The flexible plug also has a channel formed on an inserting surface of the flexible plug. The channel is located between outermost flexible plug thru-holes and the outer peripheral surface of the flexible plug.

When the ribs on the flexible plug are compressed within the perimeter wall encompassing the internal space, the channel is able to absorb the compression applied to the circumferential portion of the insertion surface of the flexible plug, thus preventing positional displacement of the thru-holes within the flexible plug, and thus maintaining straight and concentrically aligned passages between the thru-holes and terminal chambers.

According to the above-described construction, the channel, which is formed on the insertion surface of the flexible plug, is able to compress through the narrowing of the channel space as a result of the pressure applied when the flexible plug is inserted into the internal space of the base housing. Therefore, the flexible plug thru-holes, which are enclosed by the channel, are substantially unaffected by the radial constriction of the flexible plug, and thus the concentric alignment between the terminal chambers and thru-holes is maintained.

It is preferable that the channel be formed on the surface of the flexible plug as a continuous loop. Doing so will result in a uniform reduction of pressure at the thru-holes located near the peripheral region of the insertion surface of the flexible plug. Moreover, a continuous loop channel will also prevent variations in the pressure applied against the aforesaid ribs by the inner walls of the internal space.

According to the another aspect of the present invention, a waterproof electrical connector is provided including a base housing that has a plurality of terminal chambers and an internal space defined by a perimeter wall located behind the plurality of terminal chambers, a rear cover that is configured to engage with the base housing to seal the internal space, a flexible plug that extends from an inner surface of the rear cover, the flexible plug being configured to be inserted into the internal space, and ribs that are formed on an outer peripheral surface of the flexible plug. The rear cover has a plurality of thru-holes, and the flexible plug has a plurality of thru-holes. The rear cover thru-holes and the flexible plug thru-holes are configured to concentrically align with the plurality of terminal chambers. Each outermost thru-hole of the plurality of flexible plug thru-holes is axially curved outward toward an inserting end of the flexible plug.

When the ribs on the flexible plug are compressed within the perimeter wall defining the internal space, the pressure applied to the outwardly curved outermost thru-holes results in their inward displacement which straightens and concentrically aligns the thru-holes with each corresponding terminal chamber.

When the flexible plug is constricted through insertion into the internal space in the base housing, the outermost thru-holes in the flexible plug, as a result of their outwardly curved axis, are displaced into straight and concentric alignment with corresponding terminal chambers, thus providing a mechanism that prevents misalignment between the thru-holes and terminal chambers.

In another version of the present invention, a waterproof electrical connector is provided in which the rear cover has a plurality of thru-holes, and the flexible plug has a plurality of thru-holes. The rear cover thru-holes and the flexible plug thru-holes are configured to concentrically align with the plurality of terminal chambers. Each outermost thru-hole of the plurality of rear cover thru-holes has a diameter larger than a diameter of interior thru-holes of the plurality of rear cover thru-holes. An inward wall portion of each outermost thru-hole of the plurality of flexible plug is inclined outward toward an inserting end of the flexible plug so that a diameter of the outermost flexible plug thru-hole decreases toward the inserting end, when the flexible plug is separated from the base housing.

When the ribs on the flexible plug are compressed within the perimeter wall defining the internal space, the constrictive pressure applied to the peripheral edge of the inserting side of the flexible plug deforms the opening part of each thru-hole into concentric alignment with each corresponding terminal chamber, thus providing a mechanism that prevents misalignment between the thru-holes and terminal chambers.

When the flexible plug is constricted through insertion into the internal space provided in the base housing, the outermost thru-holes, that is, the thru-holes whose inward wall parts incline outwardly, concentrically align with the terminal chambers as a result of the aforesaid constriction, thus providing a mechanism that prevents misalignment between the thru-holes and terminal chambers.

In still another version of the present invention, a waterproof electrical connector is provided in which the rear cover has a plurality of thru-holes, and the flexible plug has a plurality of thru-holes. The rear cover thru-holes and the flexible plug thru-holes are configured to concentrically align with the plurality of terminal chambers. An outward wall portion of each outermost thru-hole of the plurality of flexible plug thru-holes is inclined outward from an end connecting to the rear cover to an inserting end so that a diameter of the outermost flexible plug thru-hole increases toward the inserting end, when the flexible plug is separated from the base housing.

Therefore, when the ribs on the flexible plug are compressed within the perimeter wall defining the internal space, the constrictive pressure applied to the peripheral edge of the inserting side of the flexible plug deforms the opening part of each thru-hole into concentric alignment with each corresponding terminal chamber, thus providing a mechanism that prevents misalignment between the thru-holes and terminal chambers.

When the flexible plug is constricted through insertion into the internal space in the base housing, the outer wall part of the outermost thru-holes (each outermost thru-hole having an outwardly inclined outward wall part that forms a gradually increasing thru-hole diameter) is pressed inward to a point where the thru-hole substantially concentrically aligns with the terminal chambers, thus providing a mechanism that prevents misalignment between the thru-holes and terminal chambers.

An inner housing may be provided in the internal space of the base housing, and the inner housing may incorporate thru-holes that concentrically align with the terminal chambers in the base housing and the thru-holes in the flexible plug and rear cover. A connector housing of this type, that is, a connector housing including a separately constructed base housing and inner housing, may be used because of the convenience in molding process, and so on, and allows the wire terminals to be inserted into the terminal chambers in the base housing via the thru-holes in the inner housing. Thus, this type of connector housing concentrically aligns the thru-holes in the inner housing with the terminal chambers as well as the thru-holes in the flexible plug and rear cover, thus allowing the smooth insertion of the wire connector terminals attached to the wire ends.

A wire terminal, which is attached to a wire end, is inserted through the thru-holes provided in the rear cover, flexible plug, and inner housing. An engaging portion may be provided in at least one thru-hole in the inner housing. The engaging portion may engage with a corresponding engaging portion provided on the wire terminal. Thus, the front portion of the wire terminal securely resides within each terminal chamber.

By eliminating misalignment between the flexible plug thru-holes and terminal chambers (by the channel, or by axial curve and inclined wall portion of the flexible plug thru-holes, as described above), the above-described flexible plug allows the smooth and unobstructed insertion of the wire terminals into the terminal chambers via the thru-holes in the rear cover, flexible plug, and inner housing. After insertion, the wire connector terminals are securely locked into position by the engaging portion provided in the inner housing.

In further aspect of the present invention, a waterproof electrical connector is provided including a base housing that has a plurality of terminal chambers and an internal space defined by a perimeter wall located behind the plurality of terminal chambers, an inner housing installed to a floor of the internal space in the base housing, a rear cover configured to engage with the base housing to seal the internal space, a flexible plug extending from an inner surface of the rear cover, the flexible plug being configured to be inserted into the internal space, and ribs formed on an outer peripheral surface of the flexible plug. The rear cover has a plurality of thru-holes, and the flexible plug has a plurality of thru-holes. The rear cover thru-holes and the flexible plug thru-holes are configured to concentrically align with the plurality of terminal chambers. A distortion suppressing flange extends from a perimeter of an inserting surface of the flexible plug, and a ledge is formed in a perimeter wall of the inner housing. The ledge is configured to engage with the distortion suppressing flange.

The fitting of the distortion suppressing flange over the ledge on the inner housing has the effect of maintaining the flexible plug thru-holes in concentric alignment with the inner housing thru-holes, despite the compression of the ribs of the flexible plug within the perimeter wall that defines the internal space of the base housing.

According to this construction, when the flexible plug is radially compressed as a result of its insertion into the internal space of the base housing, the attachment of the distortion suppressing flange on the flexible plug to the ledge on the inner housing has the effect of minimizing the distortion of the flexible plug, thus forming a mechanism that prevents the thru-holes in the flexible plug from being displaced out of alignment with the terminal chambers in the base housing.

The inner housing may be previously (firstly) installed within the internal space of the base housing. Doing so will axially align the thru-holes in the inner housing with the terminal chambers and thru-holes in the flexible plug and rear cover, thus allowing the smooth and unobstructed insertion of the connector terminals into the terminal chambers.

Alternatively, the inner housing may be previously attached to the inserting side of the flexible plug, and installed into the internal space in the base housing together with the flexible plug. Because the distortion suppressing flange on the flexible plug is already attached to the ledge on the inner housing, the flexible plug can be easily inserted into the base housing, without distortion, even though a load is applied to the perimeter of the inserting side of the flexible plug.

It is preferable that the distortion suppressing flange be formed as a continuous loop that extends from the perimeter of the inserting surface of the flexible plug, and that the aforesaid ledge be formed as a continuous loop on an end of the inner housing. This type of structure uniformly reduces the pressure applied to the thru-holes in proximity to the perimeter at the inserting side of the flexible plug. In addition, variations of compressive forces on the ribs, which are pressed by the interior surface of the internal space can be prevented.

Moreover, it is preferable that the flexible plug and rear cover be formed as a single piece by double-molding, in which the flexible plug is made from a resilient elastomer, and the rear cover from a hard synthetic resin (hereinafter, referred to as hard resin).

Such a structure, in which the flexible plug is formed as an integral component of the rear cover, provides for easier and more efficient assembly of the electrical connector, and prevents misalignment between the thru-holes in the flexible plug and rear cover when the base part of the flexible plug is constricted as a result of its insertion into the internal space provided in the base housing. This structure is thus able to maintain an accurately aligned insertion path, extending from the first insertion point at the rear cover to the terminal chamber, through which the wire terminal can be inserted.

Alternatively, the flexible plug, which extends from the internal surface of the rear cover, may be formed as a separate component from the rear cover, and then attached to the rear cover through an interlocking joint, instead of double-molding.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The following will describe embodiments of the present invention with reference to the attached drawings.

Figure 1:
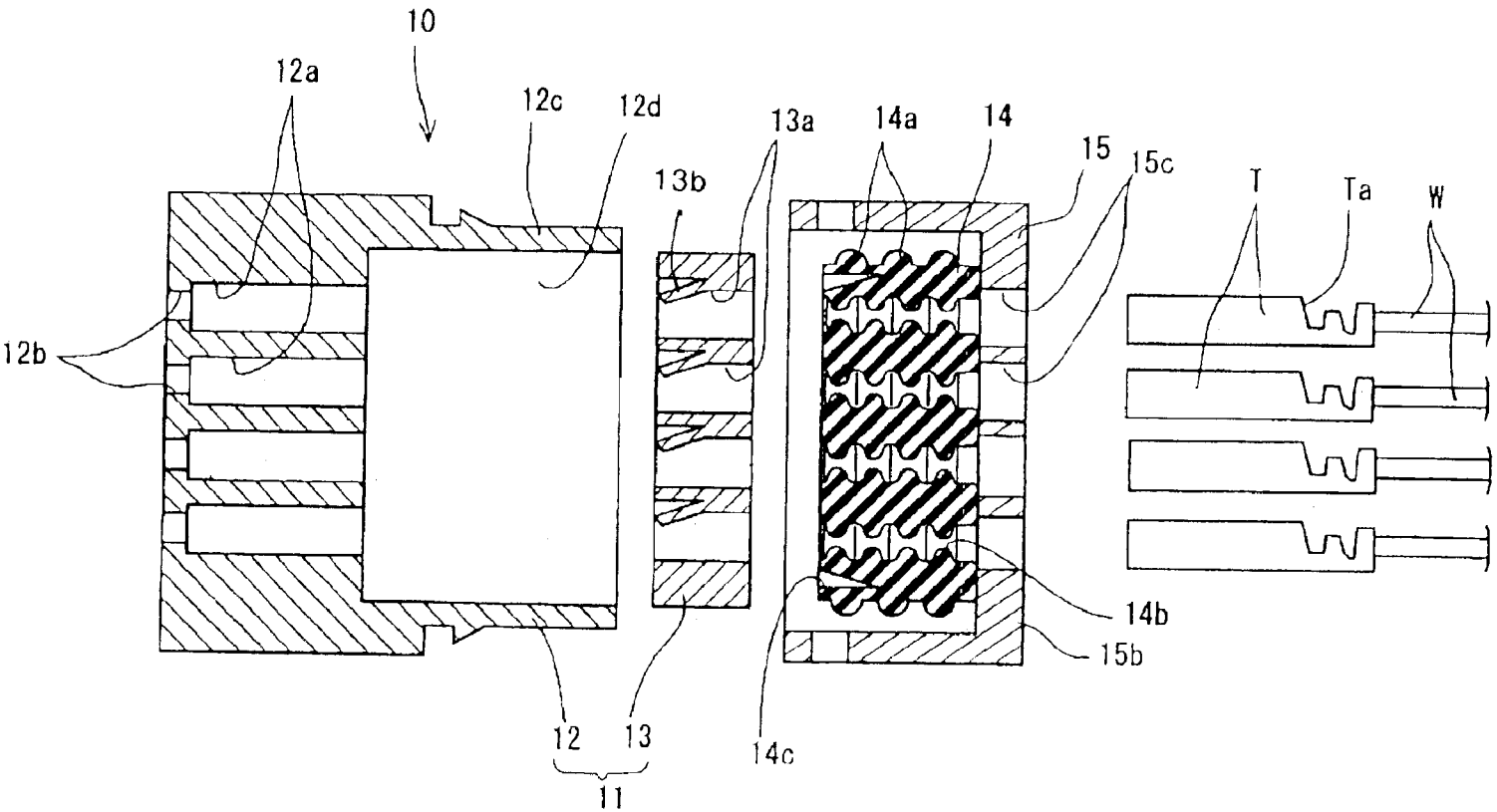
FIG. 1 is an exploded cross sectional view of a waterproof electrical connector according to the first embodiment of the present invention.

FIGS. 1 through 5 illustrate a first embodiment of the present invention. As shown in FIG. 1, waterproof electrical connector 10 includes two-piece housing 11 which has base housing 12 and inner housing 13, both being made of any suitable material, for example, a synthetic resin. Connector 10 also includes flexible plug 14 through which all of multiple wires W pass, rear cover 15 which attaches to the rear side of base housing 12, and wire terminals T which are attached to the ends of wires W and which reside within base housing 12.

Multiple rows of terminal chambers 12*a* (arranged in a matrix) are formed within base housing 12 and pass completely therethrough. Insertion orifices 12*b*, which are located at the front face of the connector, provide spaces through which male wire terminals (not shown in the drawings) of an opposite connector, that connect to wire terminals T, may be inserted. Internal space 12*d*, which serves as a repository for inner housing 13 and flexible plug 14, is defined by perimeter wall 12*c* located at the rearward side of base housing 12, and connects to the rear part of multiple terminal chambers 12*a* that are formed within base housing 12.

Figure 5:
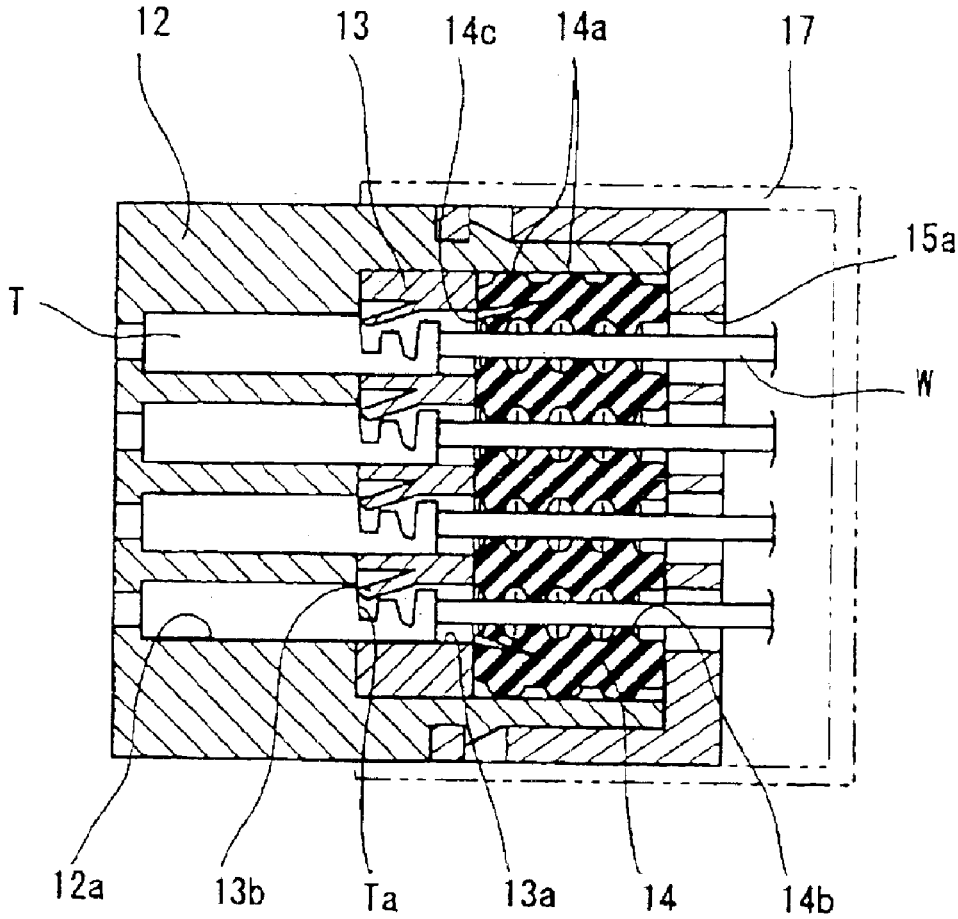
FIG. 5 is a cross section of the electrical connector showing wire connector terminals inserted into the terminal chambers, according to the first embodiment.
Figure 6:
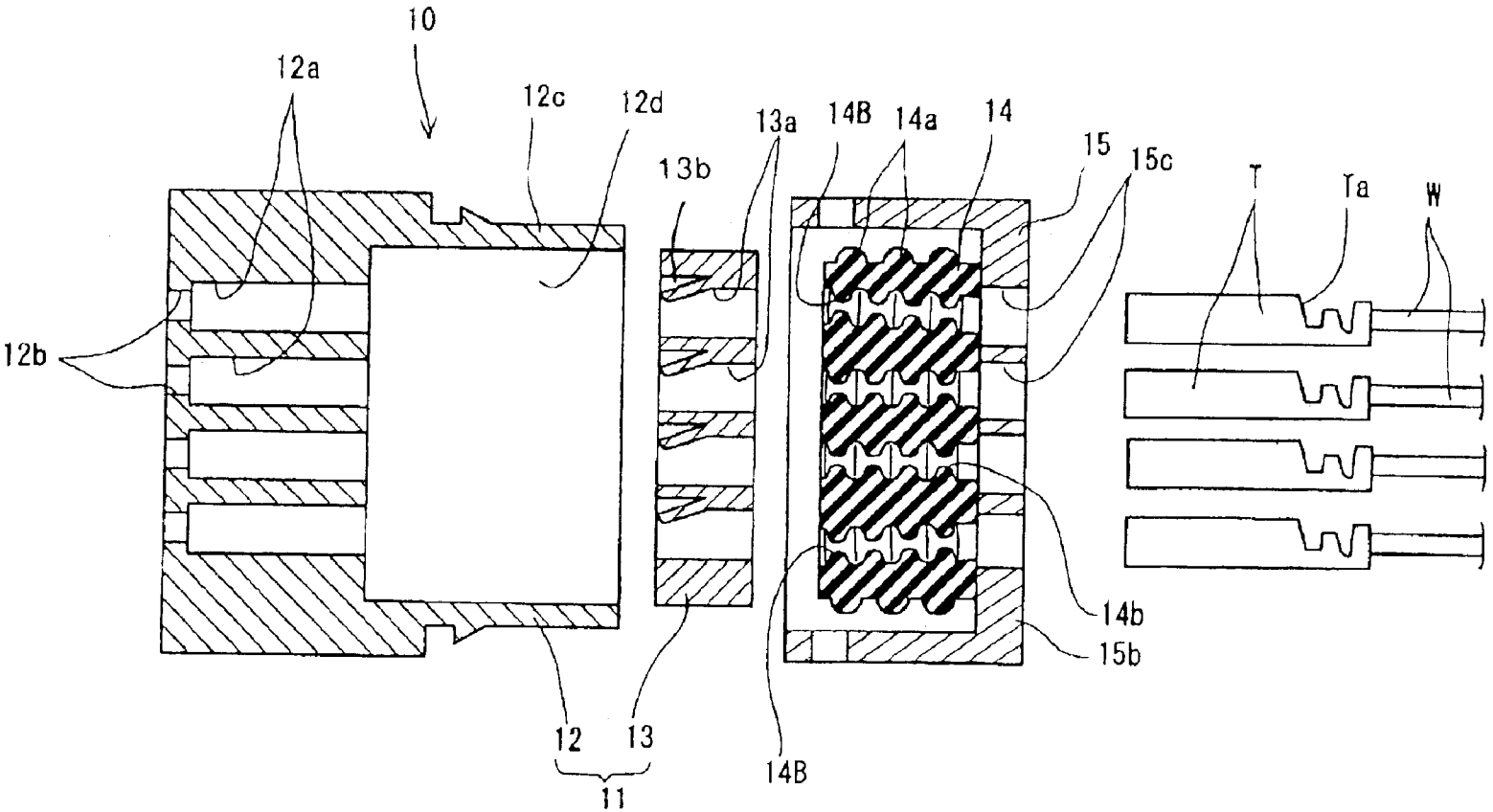
FIG. 6 is an exploded cross sectional view of a waterproof electrical connector according to the second embodiment of the present invention.
Figure 7A:
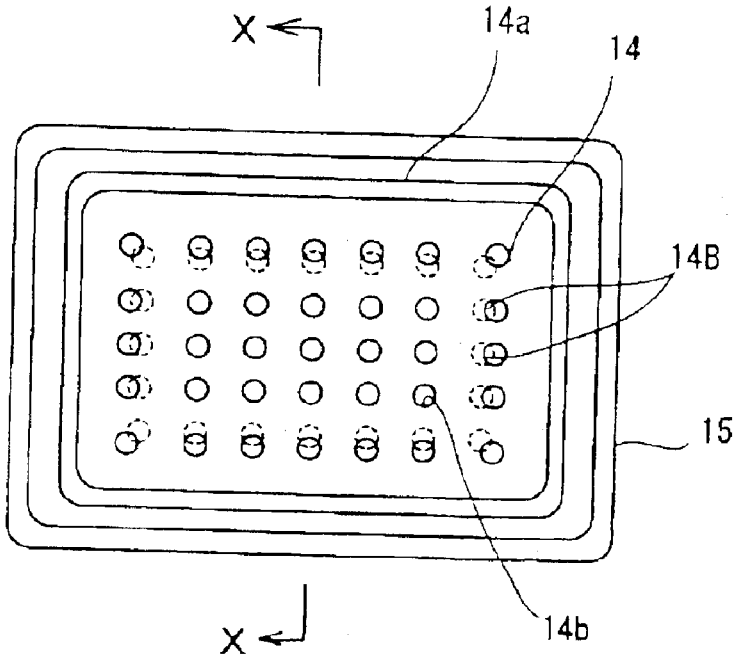
FIG. 7A is a plan view of the flexible plug and rear cover according to the second embodiment.
Figure 7B:
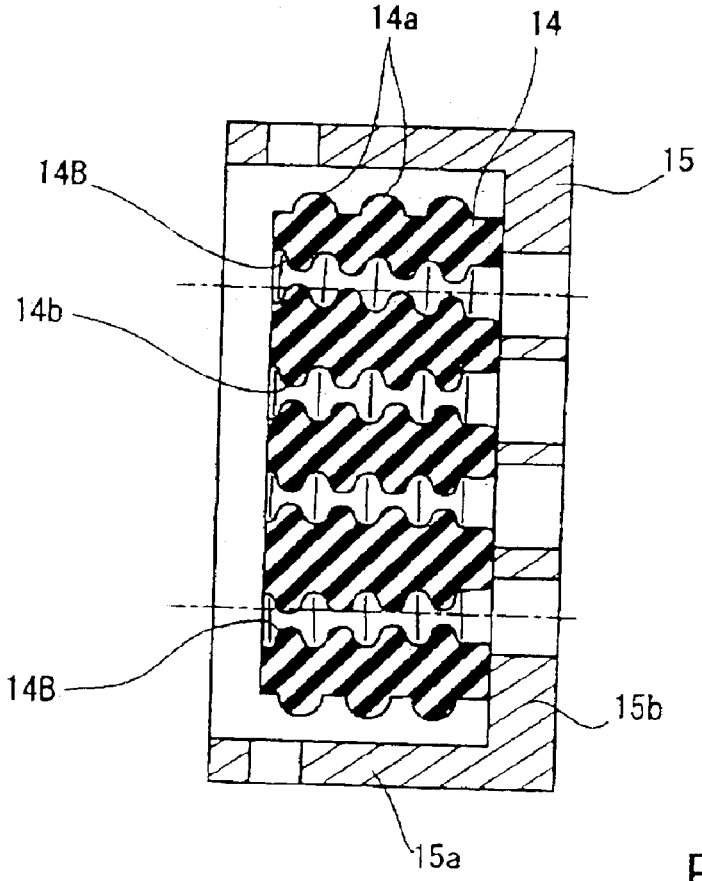
FIG. 7B is a cross section taken along the line X—X in FIG. 7A.

Inner housing 13 is installed to the innermost part of internal space 12*d*, and thus leaves space for the installation of flexible plug 14 in the remaining rear portion therein. Thru-holes 13*a* are formed in inner housing 13 so that each thru-hole 13*a* is concentrically aligned with each terminal chamber 12*a* in base housing 12. Lock tab 13*b* protrudes from an internal surface of each thru-hole 13*a* to engage with stop edge Ta of wire terminal T to secure the position of each wire terminal T within the connector. In this embodiment, as shown in FIG. 5, lock tab 13*b* is a cantilevered member that extends into the entrance of terminal chamber 12*a* in the direction in which wire terminal T is inserted. The rearward extremity of wire terminal T forms a jaw that serves as stop edge Ta, and thus the removal of wire terminal T is prevented by a latch-like mechanism. However, the structure of the engagement between the terminal T and the inner housing 13 is not limited to this embodiment, as long as a structure is provided that can securely hold wire terminal T within base housing 12. For example, a protruding member and a hole engaging therewith, or a projection and a recess engaging with each other can also be used. In addition, the latch engagement structure can be provided in less than all thru-holes of the inner housing, and/or wire terminals.

Figure 2A:
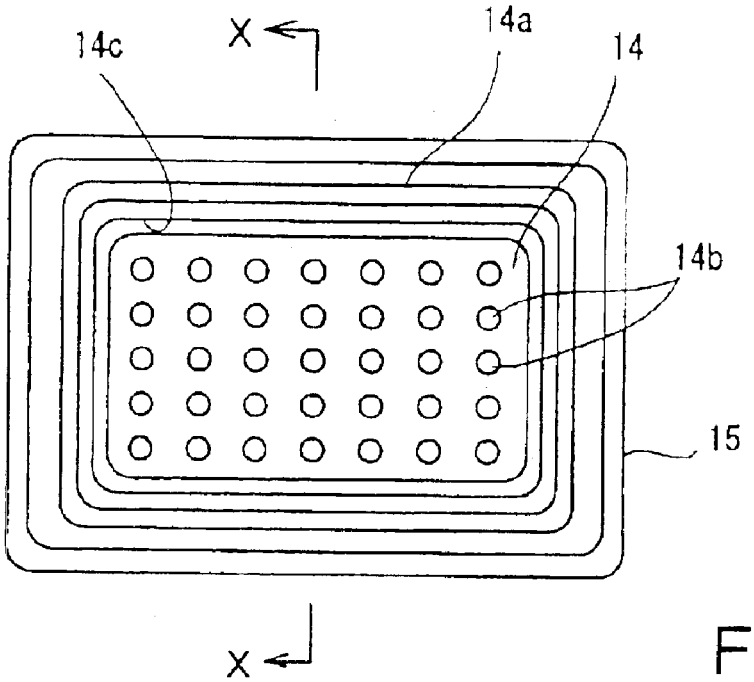
FIG. 2A is a front view of a flexible plug and a rear cover integrated as a single component according to the first embodiment.
Figure 2B:
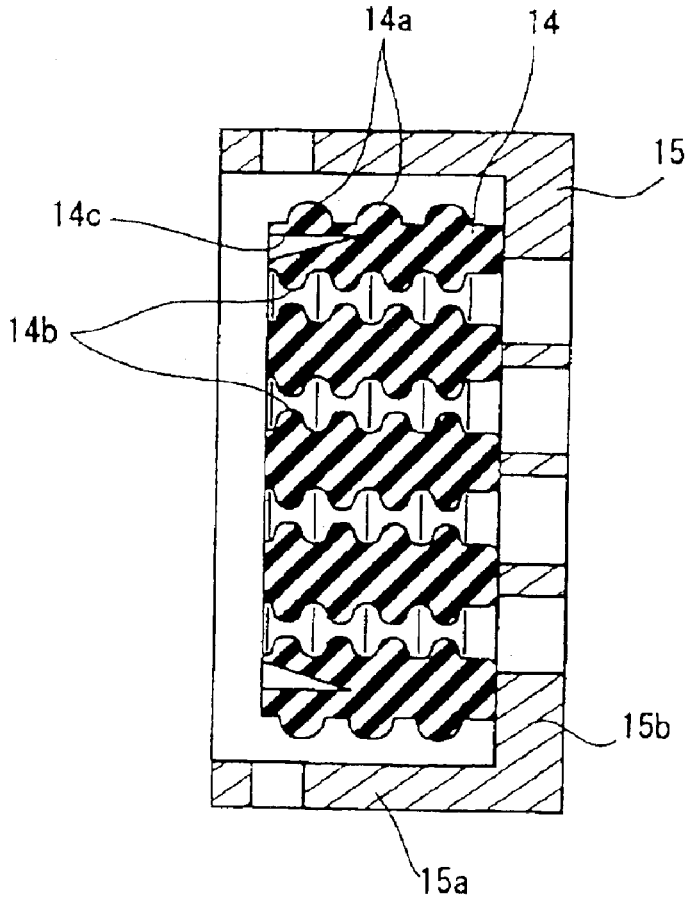
FIG. 2B is a cross section of FIG. 2A taken along the line X—X in FIG. 2A.
Figure 3:
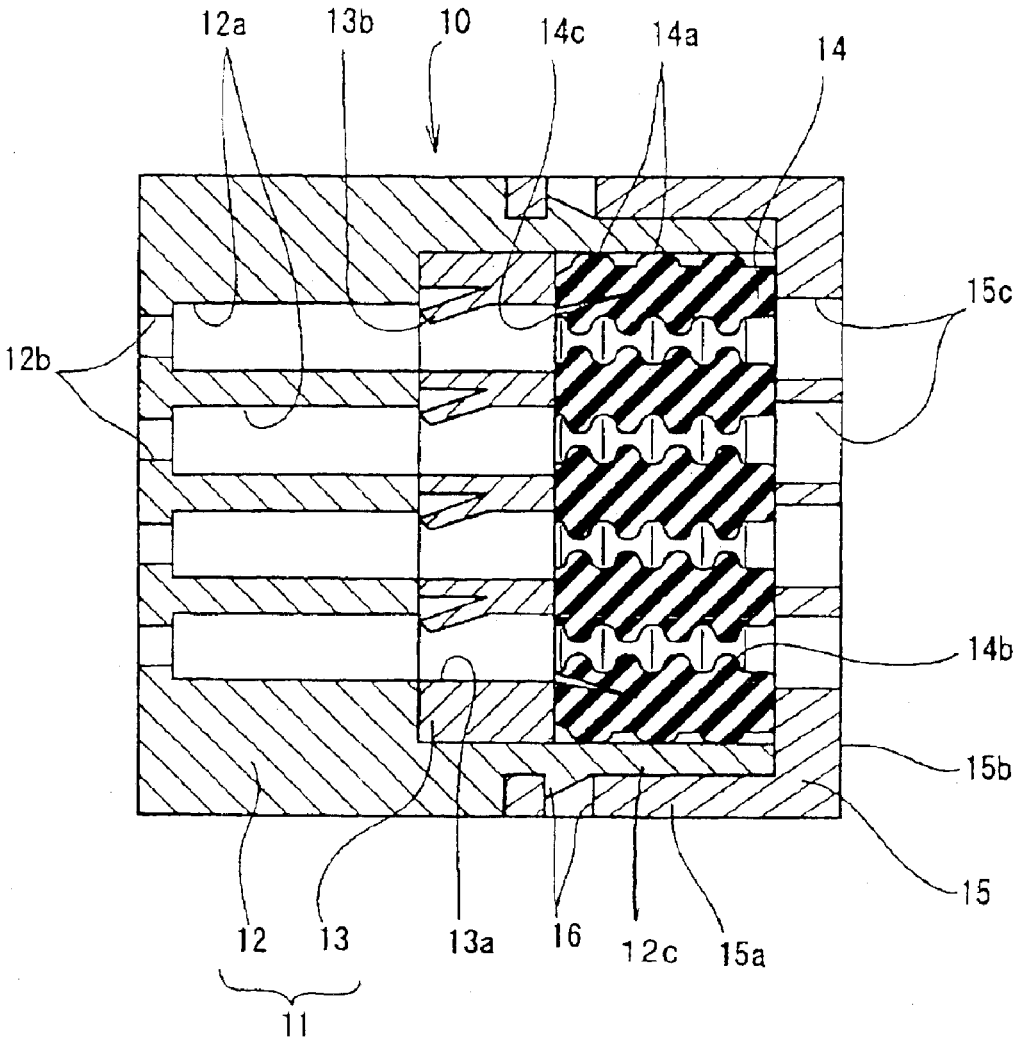
FIG. 3 is a cross section of an assembled connector including the base housing, inner housing, and flexible plug/rear holder, according to the first embodiment.

As shown in FIGS. 2A and 2B, flexible plug 14 is a square, brick-shaped component made from any suitable material, such as a flexible elastomer and shaped to an external contour that corresponds to that of internal space 12*d*. Multiple ribs 14*a* extend from the perimeter surface of flexible plug 14 and, as shown in FIG. 3, press against the internal surface of perimeter wall 12*c* when flexible plug 14 is installed to internal space 12*d*. Moreover, multiple thru-holes 14*b*, which run completely through flexible plug 14, are located in concentric alignment with each terminal chamber 12*a* and thru-hole 13*a* in inner housing 13. The internal surface of each of thru-holes 14*b* is formed to a wave-like contour in the axial direction to a dimension that allows flexible plug 14 to elastically grip the external surface of each wire W in each thru-hole 14*b*.

Moreover, channel 14*c*, which is cut into the surface of the inserting side of flexible plug 14 in the rearward direction, is located between outermost thru-holes 14*b* and the external surface of flexible plug 14. Channel 14*c* is approximately V-shaped in cross section with the narrow end of the V-shape extending into flexible plug 14. Viewed from the inserting surface of flexible plug 14, channel 14*c* encompasses outermost thru-holes 14*b*, and provides a continuous space that separates thru-holes 14*b* from the external surface on which ribs 14*a* are formed. As a result, when ribs 14*a* are compressed in the radial direction, channel 14*c* absorbs the compression applied through ribs 14*a*.

As shown in FIGS. 1 and 2A/B, rear cover 15, which is a cap-shaped component usually made from the same synthetic resin as base housing 12, but which may be made from any suitable material, attaches to the rearward surface of perimeter wall 12*c* to seal internal space 12*d* of base housing 12. Latch mechanism 16, as shown in FIG. 3, is formed on sidewall 15*a* of rear cover 15 and on perimeter wall 12*c* of base housing 12, thus securing rear cover 15 to perimeter wall 12*c*. Moreover, thru-holes 15*c* are formed within base plate 15*b* of rear cover 15, to allow the insertion of wire terminals T therein, each thru-hole 15*c* being concentrically aligned to a corresponding thru-hole 14*b* in flexible plug 14.

In this embodiment, flexible plug 14, made from a resilient (soft) elastomer, and rigid resin rear cover 15 are combined by double-molding to form a single component exhibiting two different material properties, and incorporating thru-holes 14*b* and 15*c* in mutual concentric alignment. This type of structure, in which the rear surface of flexible plug 14 is securely attached to the internal side of base plate 15*b* of rear cover 15, prevents a change in spacing between thru-holes 14*b* or misalignment between the thru-holes 14*b* and thru-holes 15*c* when ribs 14*a* are radially compressed as a result of flexible plug 14 being inserted into internal space 12*d*.

Furthermore, as shown in FIG. 5, connector cover 17 may be attached to base housing 12 to support each wire W whose wire terminal T resides in terminal chamber 12*a* and whose opposite end passes through rear cover 15 to the external environment. Connector cover 17 may also be employed to guide each wire W out of connector 10 in the sideward direction.

The following will explain the operation and effects of waterproof connector 10 according to the first embodiment.

Figure 4A:
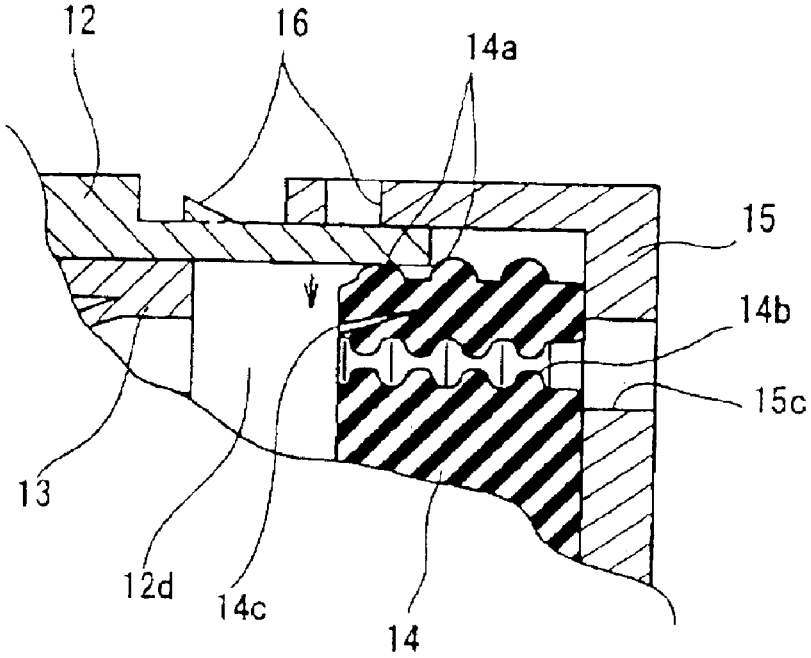
FIG. 4A is a detailed cross section showing the flexible plug partially inserted into the internal space in the base housing, according to the first embodiment.
Figure 4B:
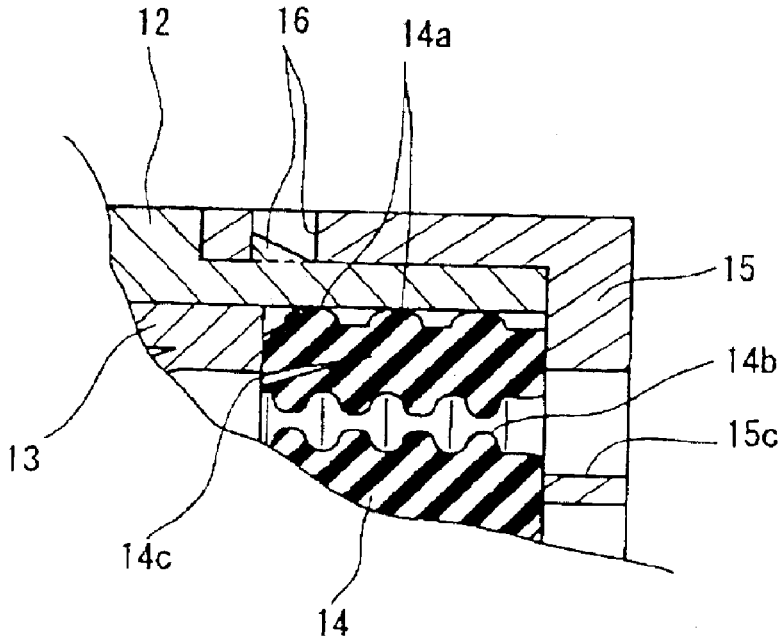
FIG. 4B is the same detailed cross section with the flexible plug fully inserted.

As shown in FIG. 3, inner housing 13 is inserted into internal space 12*d* in base housing 12, thereby concentrically aligning each thru-hole 13*a* with a corresponding terminal chamber 12*a*. Flexible plug 14, which is integrated with a rear cover 15 as one-piece is then inserted into internal space 12*d*, thus resulting in ribs 14*a* on the perimeter surface being compressed against perimeter wall 12*c* to form a waterproof seal therebetween. The position of thru-holes 14*b* located near the perimeter of flexible plug 14 (in particular, the outermost thru-holes 14*b*) will normally change as a result of the inward compression of ribs 14*a* from contact with the internal surface of perimeter wall 12*c*. However, as shown in FIGS. 4A and 4B, channel 14*c*, which is provided on the surface of the inserting side of flexible plug 14, is able to absorb the compression of ribs 14*a* through the narrowing of the channel space. This mechanism results in the constrictive pressure applied to flexible plug 14 having relatively little effect on the position of thru-holes 14*b* located near the perimeter, and therefore the positional displacement of thru-holes 14*b* can be prevented.

The base plate side positional displacement of thru-holes 14*b*, which normally results from the constrictive pressure applied to ribs 14*a*, can also be prevented because the bottom surface of flexible plug 14 is securely attached to rear cover 15 so as to create a single component including both flexible plug 14 and rear cover 15. Therefore, the complete insertion of flexible plug 14 into internal space 12*d* results in the simultaneous attachment of perimeter wall 15*a* of rear cover 15 to perimeter wall 12*c*, the engagement of latch mechanism 16, and the concentric alignment of thru-holes 15*c*, 14*b*, and 13*a* that form multiple straight passages (extending from rear cover 15 through each terminal chamber 12*a*) for the insertion of each wire terminal T.

Next, as shown in FIG. 5, wire terminal T (which is attached to the end of wire W) is inserted into thru-hole 15*c* in rear cover 15. Continued insertion results in wire terminal T pushing open thru-hole 14*b* in flexible plug 14, passing through thru-hole 13*a* in inner housing 13, and entering terminal chamber 12*a*. Thus, wire terminal T is able to enter terminal chamber 12*a* smoothly and easily because the path leading to terminal chamber 12*a* is axially straight due to the concentric alignment maintained between thru-holes 13*a*, 14*b*, and 15*c*. Once wire terminal T is completely inserted to terminal chamber 12*a*, lock tab 13*b* on inner housing 13 engages with stop edge Ta on wire terminal T to secure wire terminal T within terminal chamber 12*a*. At the same time, the constrictive pressure applied to wire W by the wall of thru-hole 14*b* forms a waterproof seal therebetween.

Furthermore, if necessary, connector cover 17 may be installed to the rear of connector 10 to protect wires W that extend from base housing 12, and to guide wires W in a sideward direction out of connector 10.

Moreover, while the first embodiment has described channel 14*c* as a continuous loop formed on the surface of the inserting side of flexible plug 14, channel 14*c* may also be formed intermittently on the surface.

FIGS. 6 through 10 illustrate a second embodiment of the present invention. Description will have been omitted for the components of this second embodiment that share identical reference numerals with those of the first embodiment.

In this embodiment, the axis of each outermost thru-hole 14B in flexible plug 14 curves outward toward an edge of the inserting side of flexible plug 14. The curve is established to an extent that allows thru-holes 14B to straighten, that is, the curved part of each thru-hole will be eliminated, when flexible plug 14 is inserted into internal space 12*d* and ribs 14*a* are pressed inward through the pressure applied by perimeter wall 12*c*. With flexible plug 14 is fully inserted into internal space 12*d*, outermost thru-holes 14B will have been pressed inward to the point where they straighten and concentrically align with thru-holes 13*a* and terminal chambers 12*a*. Moreover, because the rear surface of flexible plug 14 is joined to the inner surface of base plate 15*b* of rear cover 15, the alignment of outermost thru-holes 14B with thru-holes 15*c* on rear cover 15 is maintained even though ribs 14*a* have been compressed by the insertion of flexible plug 14 into internal space 12*d*. Therefore, only the portion of thru-holes 14*b* at the inserting side of flexible plug 14 is curved.

Figure 8:
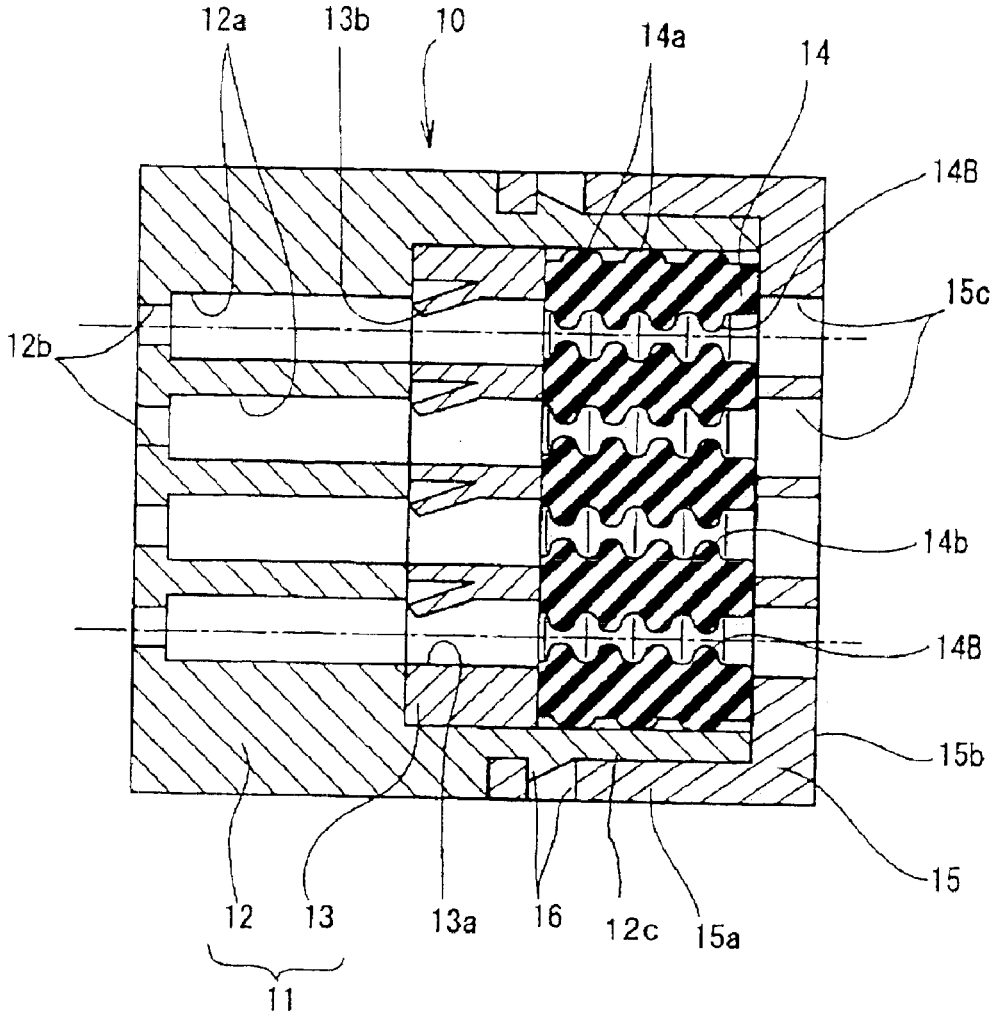
FIG. 8 is a cross section of an assembled electrical connector including the base housing, inner housing, flexible plug, and rear cover, according to the second embodiment.
Figure 9A:
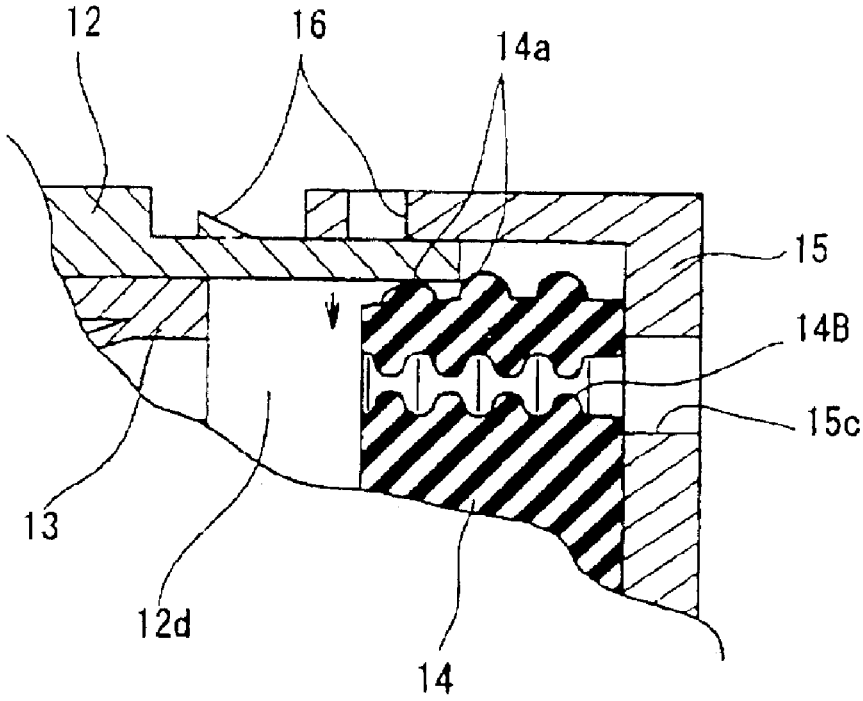
FIG. 9A is a cross section of the flexible plug of the second embodiment partially inserted in the internal space in the base housing.
Figure 9B:
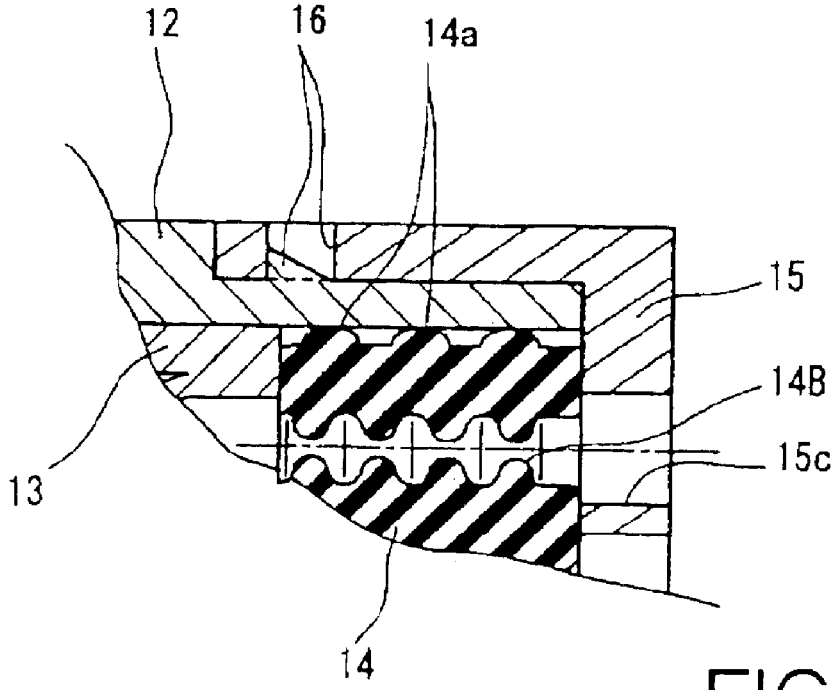
FIG. 9B is illustrates the flexible plug of the second embodiment in a completely inserted condition.

The following will explain the operation and effects of the second embodiment of the present invention in the form of waterproof connector 10. As shown in FIG. 8, inner housing 13 is inserted into internal space 12*d* in base housing 12, thereby concentrically aligning each thru-hole 13*a* with a corresponding terminal chamber 12*a*. Flexible plug 14, which is integrated with rear cover 15 as one-piece, is then inserted into internal space 12*d*, thus resulting in ribs 14*a* on the perimeter surface being compressed against perimeter wall 12*c* to form a waterproof seal therebetween. The position of outermost thru-holes 14B would normally change as a result of the inward compression of ribs 14*a* resulting from contact with the internal surface of perimeter wall 12*c*. However, because outermost thru-holes 14B curve outwardly toward the edges of the inserting side of flexible plug 14 to compensate for compression-induced displacement, thru-holes 14B are displaced along a straight axis as illustrated in FIGS. 9A and 9B. As a result, each inner thru-hole 14*b* and each outermost thru-hole 14B are maintained in concentric alignment with each corresponding terminal chamber 12*a*.

The base plate side positional displacement of outermost thru-holes 14B, which would normally result from the constrictive pressure applied to ribs 14*a*, can be prevented because the bottom surface of flexible plug 14 is securely attached to rear cover 15 so as to create a single component including both flexible plug 14 and rear cover 15. Therefore, the complete insertion of flexible plug 14 into internal space 12*d* results in the simultaneous attachment of rear cover 15 to perimeter wall 12*c*, the engagement of latch mechanism 16, and the concentric alignment of thru-holes 15*c*, 14*b*, (14B), and 13*a* that form multiple concentrically aligned passages (extending from rear cover 15 through each terminal chamber 12*a*) for the insertion of each wire connector terminal T.

Figure 10:
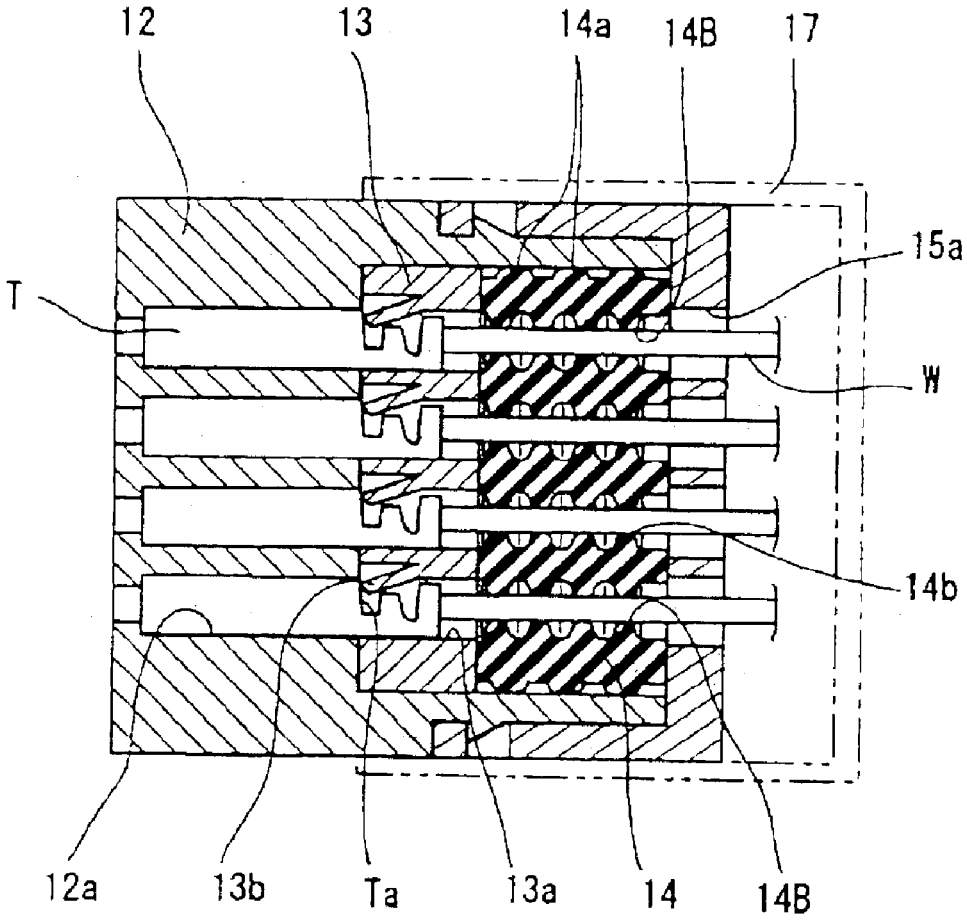
FIG. 10 is a cross section of the wire terminals completely inserted in the terminal chambers, according to the second embodiment.
Figure 11A:
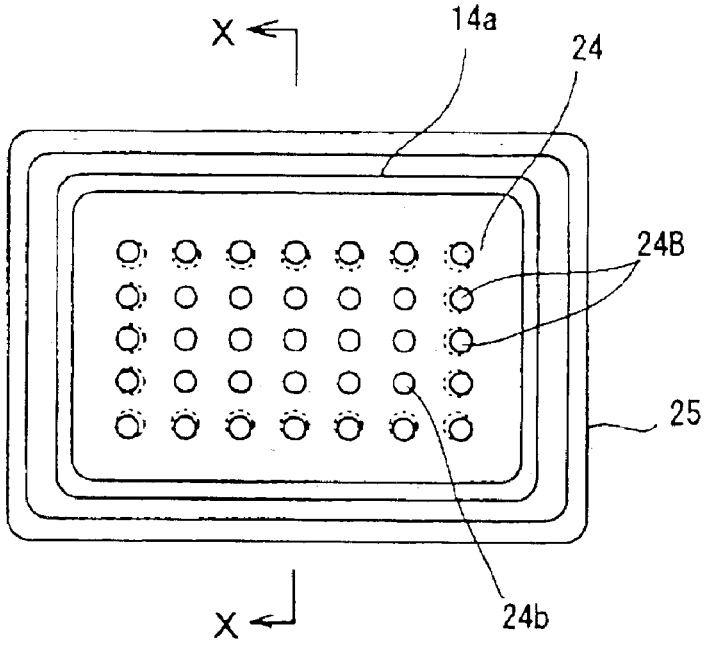
FIG. 11A is a frontal view of the flexible plug and rear cover of the third embodiment.
Figure 11B:
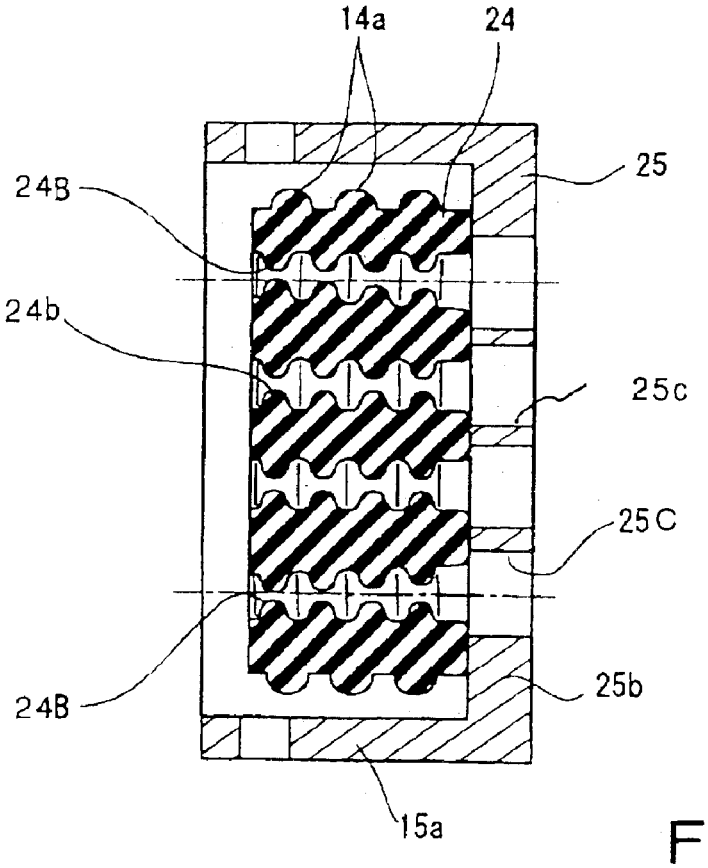
FIG. 11B is a side cross section of the FIG. 11A view taken along the line X—X.

Next, as shown in FIG. 10, wire terminal T (which is attached to the end of wire W) is inserted into thru-hole 15*c* in rear cover 15. Continued insertion results in wire terminal T pushing open thru-hole 14*b* in flexible plug 14, passing through thru-hole 13*a* in inner housing 13, and entering terminal chamber 12*a*. Wire terminal T is able to enter terminal chamber 12*a* smoothly and easily because the passage leading to terminal chamber 12*a* is completely straight due to the concentric alignment maintained between thru-holes 13*a*, 14*b*, and 15*c*. Once wire terminal T is completely inserted to terminal chamber 12*a*, lock tab 13*b* on inner housing 13 engages with stop edge Ta on wire terminal T to secure wire terminal. T within terminal chamber 12*a*. At the same time, the constrictive pressure applied to wire W by the wall of thru-hole 14*b* forms a waterproof seal therebetween.

Furthermore, if necessary, connector cover 17 may be installed to the rear portion of connector 10 to protect wires W that extend from base housing 12, and of guiding wires W in a sideward direction out of connector 10.

FIGS. 11A through 12B illustrate a third embodiment of the invention in the form of waterproof electrical connector 20. In this third embodiment, outermost thru-holes 25C in rear cover 25 are formed to a diameter larger than that of the other thru-holes 25*c*. Also, outermost thru-holes 24B in flexible plug 24 are formed to a diameter larger than that of the other thru-holes 24*b* at the part of flexible plug 14 attached to base plate 25*b* of rear cover 25. Furthermore, the inward wall part of each outermost thru-hole 24B inclines outward as it approaches the inserting side of flexible plug 24, and the outward wall part of each outermost thru-hole 24B does not incline. Thus, the diameter of each thru-hole 24B decreases as the thru-hole approaches the inserting side of flexible plug 14. Descriptions have been omitted for the components of this third embodiment that share identical identification numbers with those of the first embodiment.

In this third embodiment, the degree of the outward inclination of the inner wall part of each thru-hole 24B is determined so that, when flexible plug 24 is inserted into internal space 12*d* and compressed by the inner surface of the perimeter wall 12*c* through the pressure applied to ribs 14*a*, a generally continuing path is formed without misalignment by the inward deformation of the inner wall part by the applied pressure.

The following will explain the operation and effects of the third embodiment.

Figure 12A:
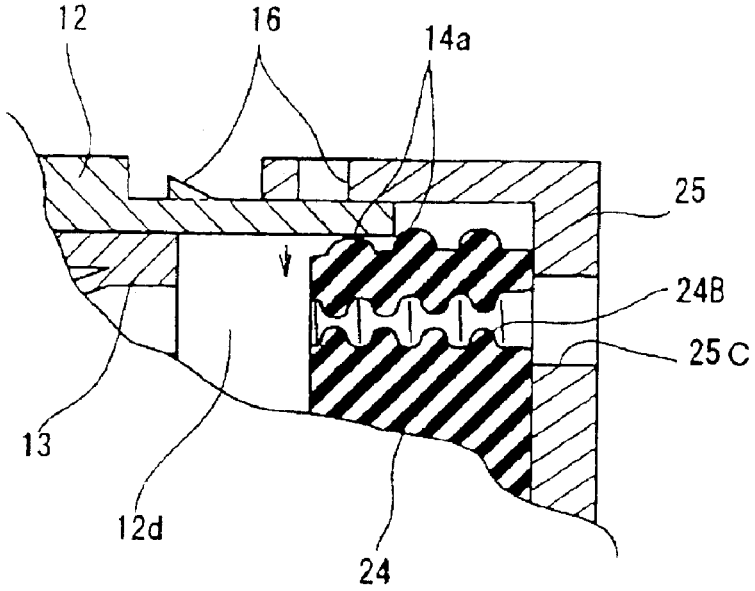
FIG. 12A is a side view cross section of the third embodiment showing the flexible plug partially inserted into the internal space in the base housing.
Figure 12B:
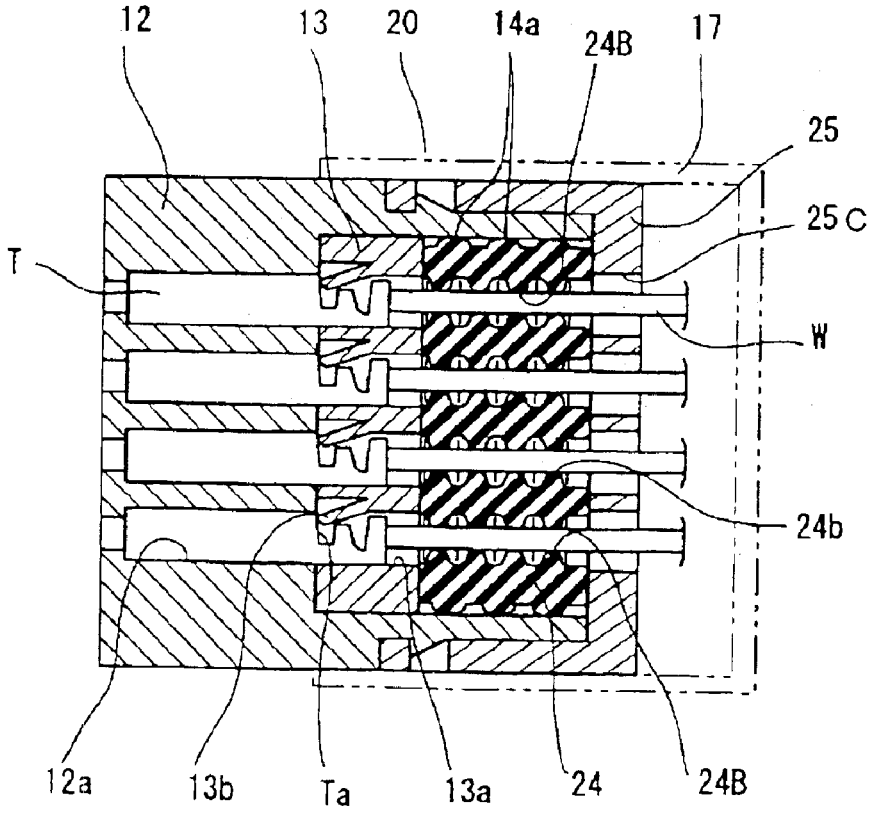
FIG. 12B is a side view cross section of the third embodiment showing the wire terminals inserted in the terminal chambers.
Figure 13A:
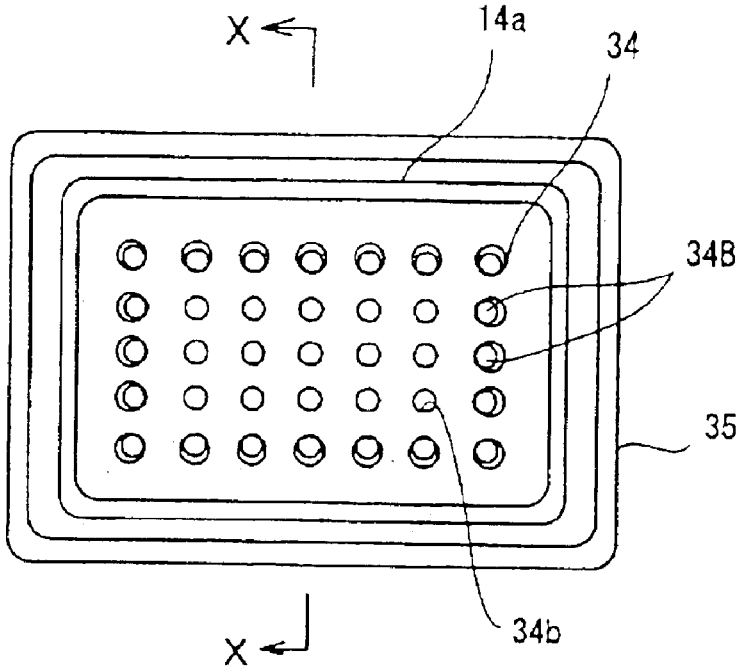
FIG. 13A is a frontal view of the flexible plug and rear cover of the fourth embodiment.
Figure 13B:
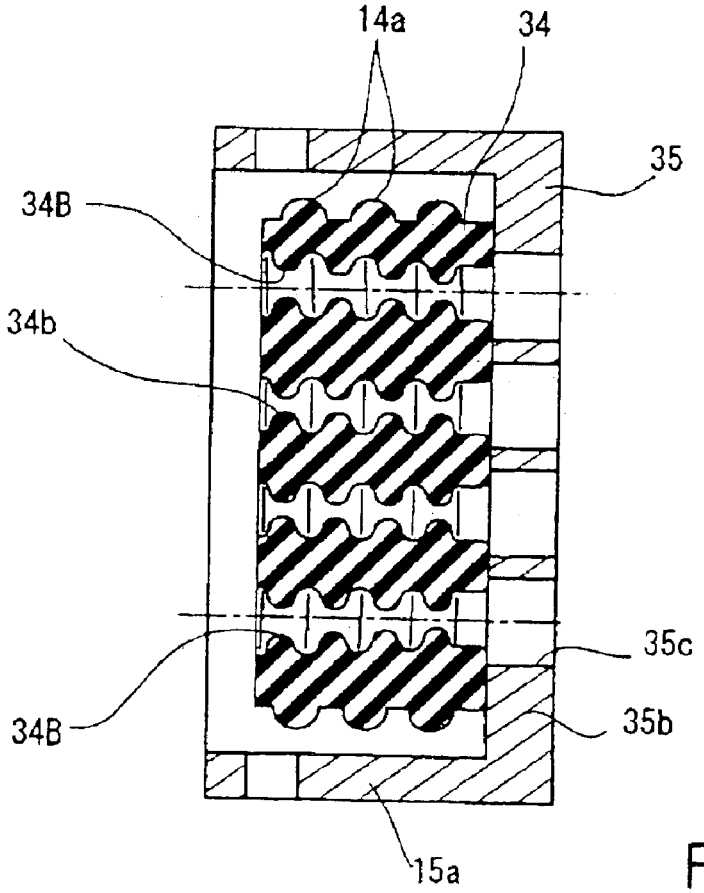
FIG. 13B is a side cross section of the FIG. 13A view taken along the line X—X.
Figure 14A:
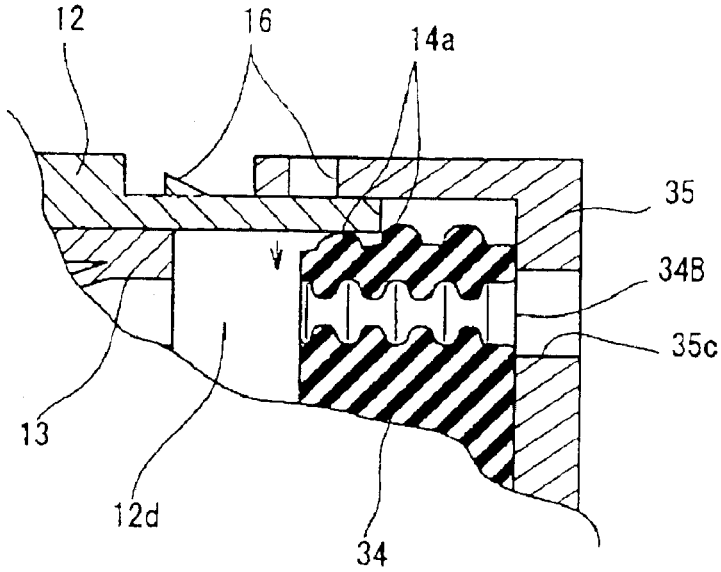
FIG. 14A is a side view a partial cross section of the fourth embodiment showing the flexible plug partially inserted into the internal space in the base housing.
Figure 14B:
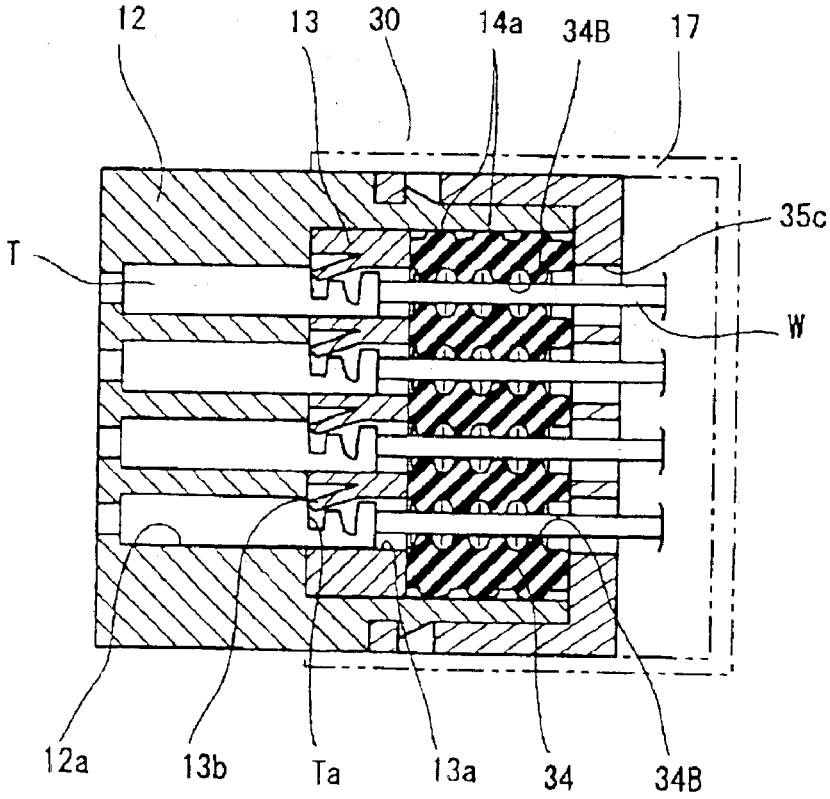
FIG. 14B is a side view cross section of the fourth embodiment showing the flexible plug the wire terminals inserted in the terminal chambers.
Figure 15:
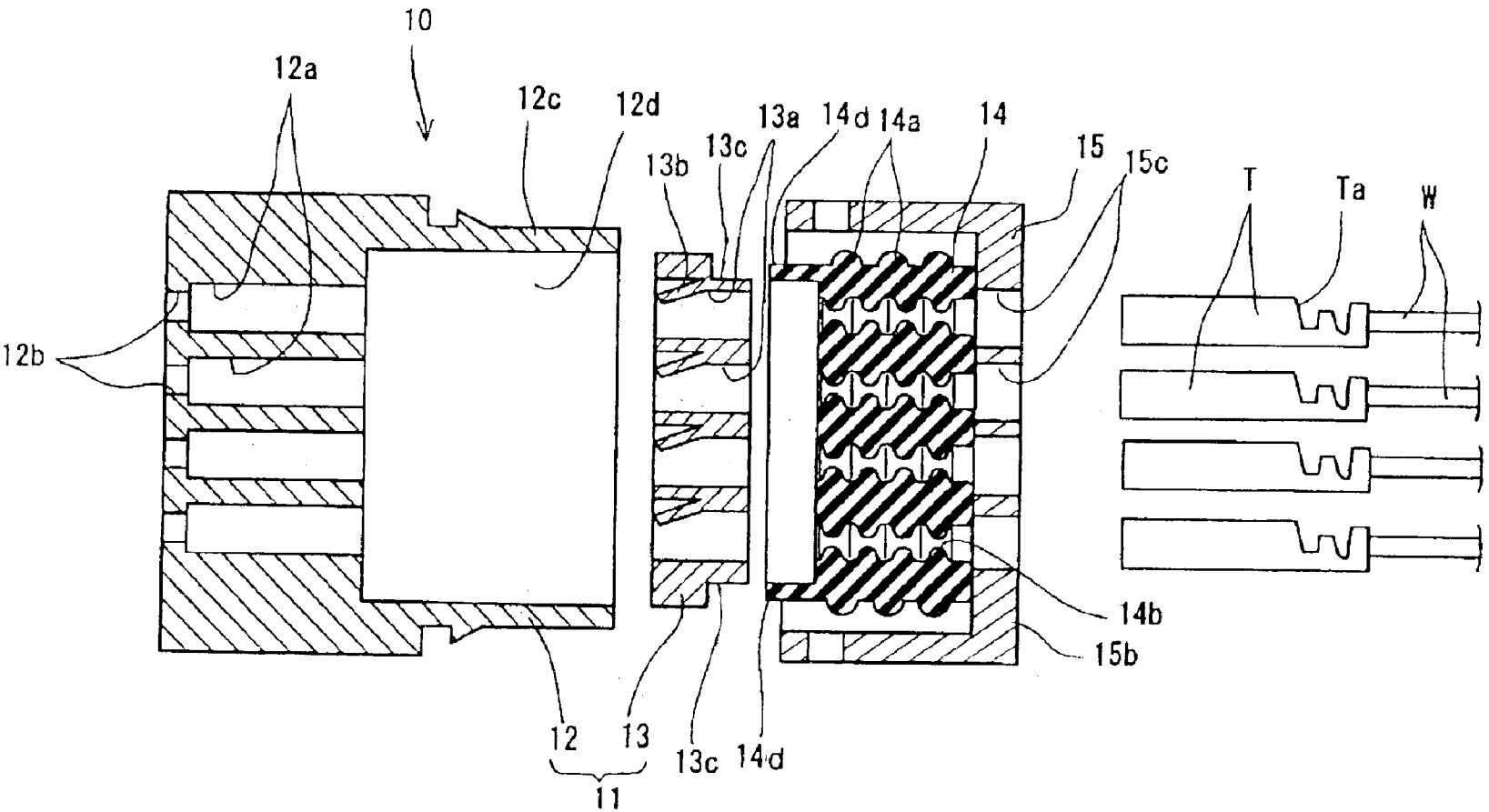
FIG. 15 is an exploded cross section of a waterproof electrical connector according to the fifth embodiment of the present invention.
Figure 16A:
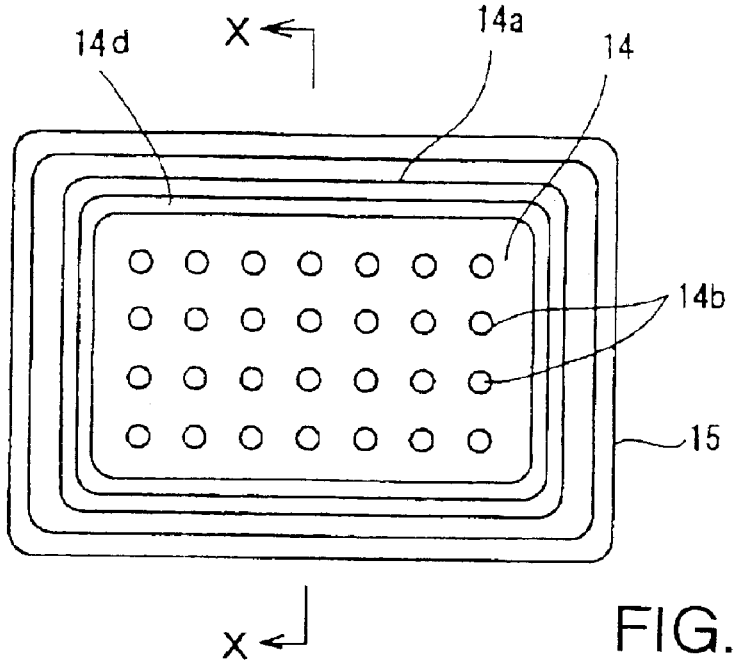
FIG. 16A is a plan view of the flexible plug and rear cover, according to the fifth embodiment.
Figure 16B:
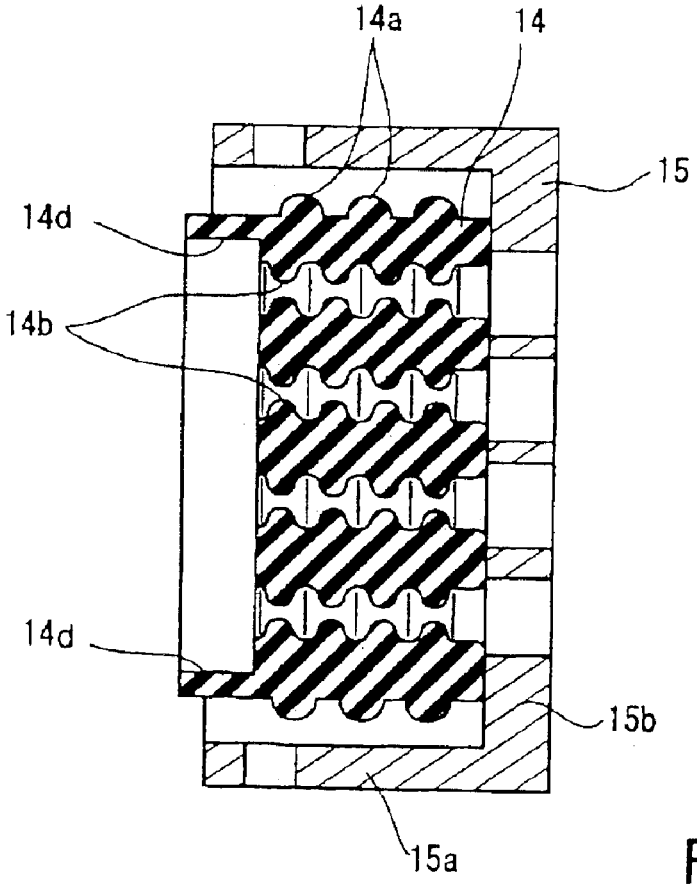
FIG. 16B is a cross section taken along the line X—X in FIG. 16A.

Similar to the first or second embodiment, inner housing 13, flexible plug 24, and rear cover 25 are installed to base housing 12. As illustrated in FIGS. 12A and 12B, ribs 14*a* of flexible plug 24 are inwardly displaced at the inserting side of flexible plug 24 as a result of pressure applied by perimeter wall 12*c* of internal space 12*d*. While each outermost thru-hole 24B is initially formed with the inward wall part inclined outward, the constrictive pressure applied to flexible plug 24 has the effect of displacing the opening to each thru-hole 24B into alignment with each corresponding terminal chamber 12*a*.

With flexible plug 24 thus installed, wire terminals T, which are attached to electrical wires W, can be inserted through thru-holes 25*c* (25C) of rear cover 25 in the same manner as described for the first or second embodiment. During the insertion process, wire terminal T forcefully expands thru-hole 24*b* (24B), passes through thru-hole 13*a* in inner housing 13, and enters terminal chamber 12*a*. Once wire terminal T is fully inserted, lock tab 13*b* on inner housing 13 engages stop with edge Ta to anchor wire terminal T in position. Wire W is elastically gripped in the radial direction by thru-hole 24*b* to form a watertight seal therebetween.

Furthermore, connector cover 17 may be installed to the rear of the connector to protect wires W that extend from base housing 12, and to guide wires W in a sideward direction out of the connector.

FIGS. 13A through 14B describe a fourth embodiment of the present invention wherein each outermost thru-hole 34B (among thru-holes 34*b* in flexible plug 34) is formed to an increasingly larger diameter as the thru-hole approaches the inserting side of flexible plug 34. More specifically, the outward wall part of each thru-hole inclines outwardly from its contact surface with base plate 35*b* to the inserting side of flexible plug 34. The opposing inner wall part does not incline, and thru-hole 34B is formed with a diameter that continuously increases as the thru-hole approaches the inserting side of flexible plug 34. Descriptions have been omitted for components of this fourth embodiment that share identical identification numbers with those of the first embodiment.

In this fourth embodiment, the degree of the outward inclination of the outer wall part of each thru-hole 34B is determined so that, when flexible plug 34 is inserted into internal space 12*d* and compressed by the inner surface of the perimeter wall 12*c* through the pressure applied to ribs 14*a*, a generally continuing path is formed without misalignment by the inward deformation of the outer wall part by the applied pressure.

The following will explain the operation and effects of the fourth embodiment.

Similar to the first through third embodiments, inner housing 13, flexible plug 34, and rear cover 35 are installed to base housing 12. Ribs 14*a* of flexible plug 34 are compressed inward at the inserting side of flexible plug 34 as a result of pressure applied by perimeter wall 12*c* of internal space 12*d*. While each outermost thru-hole 34B is initially formed with the outward wall part inclined in the outward direction to increase the diameter of the thru-hoe 34B, the constrictive pressure applied to flexible plug 34 displaces each thru-hole 34B into alignment with each corresponding terminal chamber 12*a*.

With flexible plug 34 installed, wire terminals T, which are attached to electrical wires W, can be inserted through thru-holes 35*c* of rear cover 35 in the same manner as described for the first through third embodiments. During insertion, wire terminal T forcefully expands thru-hole 34*b* (34B) of flexible plug 34, passes through thru-hole 13*a* in inner housing 13, and enters terminal chamber 12*a*. Once wire terminal T is fully inserted, lock tab 13*b* on inner housing 13 engages with stop edge Ta to anchor wire terminal T in position. Wire W elastically gripped in the radial direction by thru-hole 34*b* (34B) to form a watertight seal therebetween.

Furthermore, connector cover 17 may be installed to the rear of the connector to protect wires W that extend from base housing 12, and to guide wires W in a sideward direction out of the connector.

In the above-described embodiments, housing 11 is a 2-piece structure including base housing 12 and inner housing 13. Housing 11, however, may also be formed as a single piece structure that integrates base housing 12 and inner housing 13.

FIGS. 15 through 19 illustrate a fifth embodiment of the present invention. Description will have been omitted for the components of this fifth embodiment that share identical reference numerals with those of the first embodiment.

In this embodiment, a loop-like ledge 13*c* is provided along the entire perimeter of a rear surface on the inner housing 13. The ledge 13*c* engages with a distortion suppressing flange 14*d* extending from an inserting surface of the flexible plug 14.

Distortion suppressing flange 14*d* (hereafter referred to as flange 14*d*) extends outward in the insertion direction from the perimeter of the insertion surface of flexible plug 14. Flange 14*d* fits over ledge 13*c*, which is formed as an indented shelf-type structure extending outward from the perimeter of the rearward part of inner housing 13. Inner surface of flange 14*d* is radially pressurized in the outward direction through attachment to ledge 13*c*, thus creating a structure able to prevent distortion at the perimeter of the insertion side of flexible plug 14 when ribs 14*a* are constricted within internal space 12*d*.

The following will explain the operation and effects of the fifth embodiment of the present invention in the form of waterproof connector 10.

Figure 17:
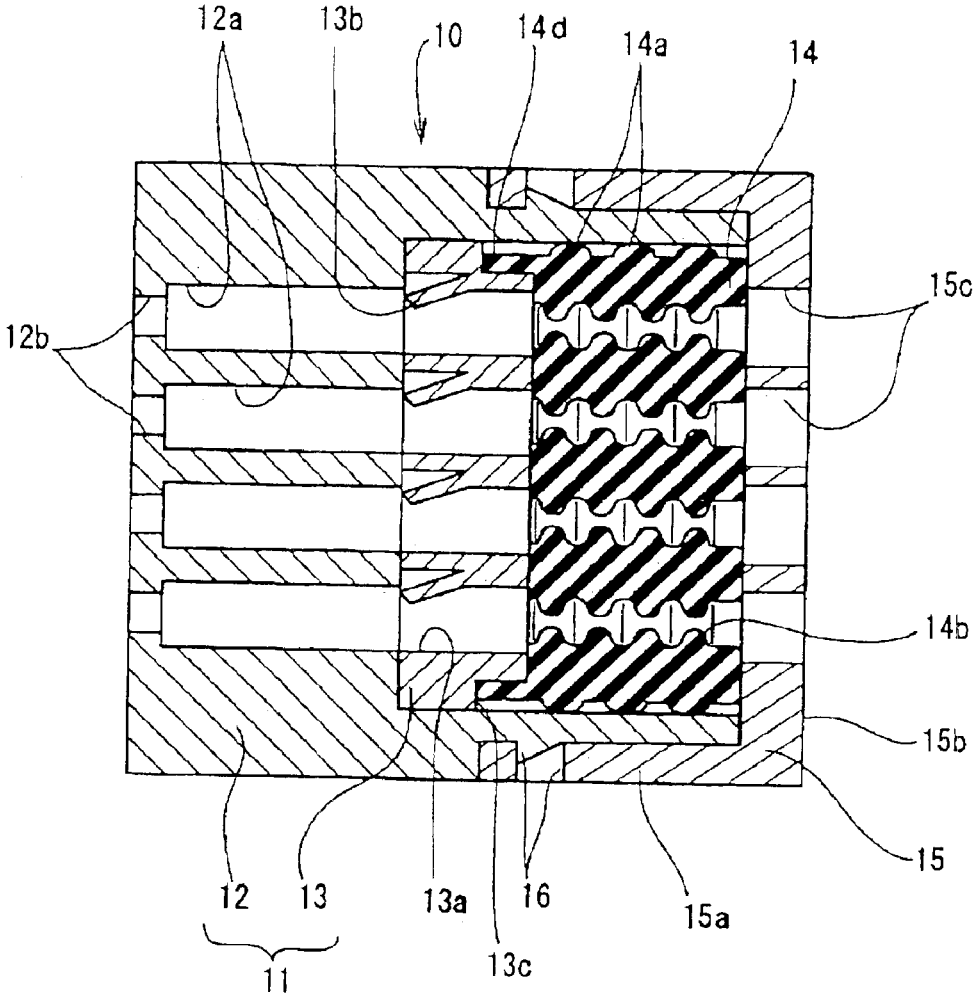
FIG. 17 is a cross section of an assembled electrical connector including the base housing, inner housing, flexible plug, and rear cover, according to the fifth embodiment.
Figure 18A:
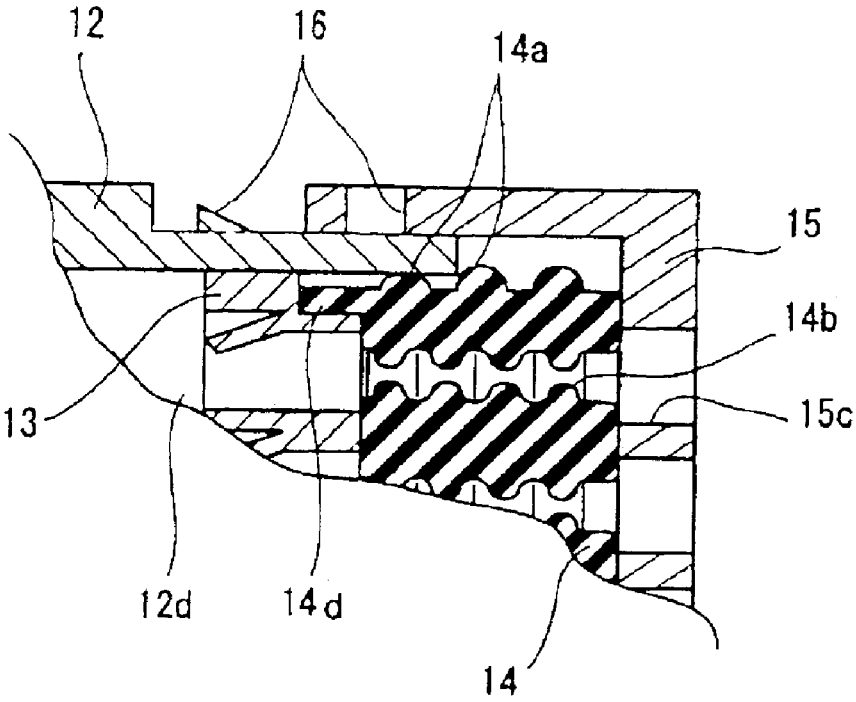
FIG. 18A is a cross section of the flexible plug partially inserted in the base housing internal space, according to the fifth embodiment.
Figure 18B:
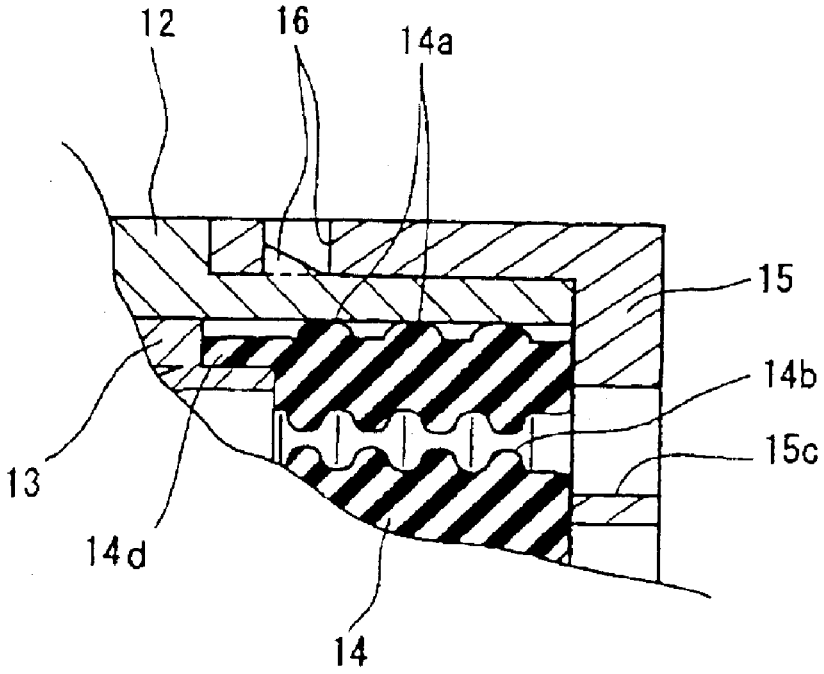
FIG. 18B illustrates the flexible plug of the fifth embodiment in a completely inserted condition.

As shown in FIG. 17, flange 14*d* fits over ledge 13*c* on inner housing 13, thereby concentrically aligning each thru-hole 14*b* with a corresponding thru-hole 13*a*. Rear cover 15, which is a single one-piece structure that includes flexible plug 14, is then inserted into internal space 12*d*, thus resulting in ribs 14*a* being compressed within perimeter wall 12*c* to form a waterproof seal therebetween. The position of thru-holes 14*b*, especially those located near the perimeter of flexible plug, would normally change as a result of the inward compression of ribs 14*a* caused by pressurized contact with the internal surface of perimeter wall 12*c*. However, because flange 14*d* fits over ledge 13*c* of inner housing 13 with the inner surface of flange 14*d* pressed outward, as shown in FIGS. 18A and 18B, there is no positional displacement at the insertion end of flexible plug 14 even though ribs 14*a* have been constricted. This structure thus substantially reduces the amount of compression applied to thru-holes 14*b* near the perimeter of flexible plug 14 and prevents misalignment.

Because flexible plug 14 and rear cover 15 are joined at the base part of rear cover 15 to form a single integrated component, the part of thru-holes 14*b* at the base of flexible plug 14 is substantially unaffected by the compression of ribs 14*a*. The complete insertion of flexible plug 14 into internal space 12*d* results in the simultaneous attachment of sidewall 15*a* of rear cover 15 to perimeter wall 12*c*, and the engagement of latch mechanism 16. This results in the straight and concentric alignment of thru-holes 15*c*, 14*b*, and 13*a* from rear cover 15 to terminal chambers 12*a*, and thus forms straightly aligned passages through which wire terminals T may be inserted.

Figure 19:
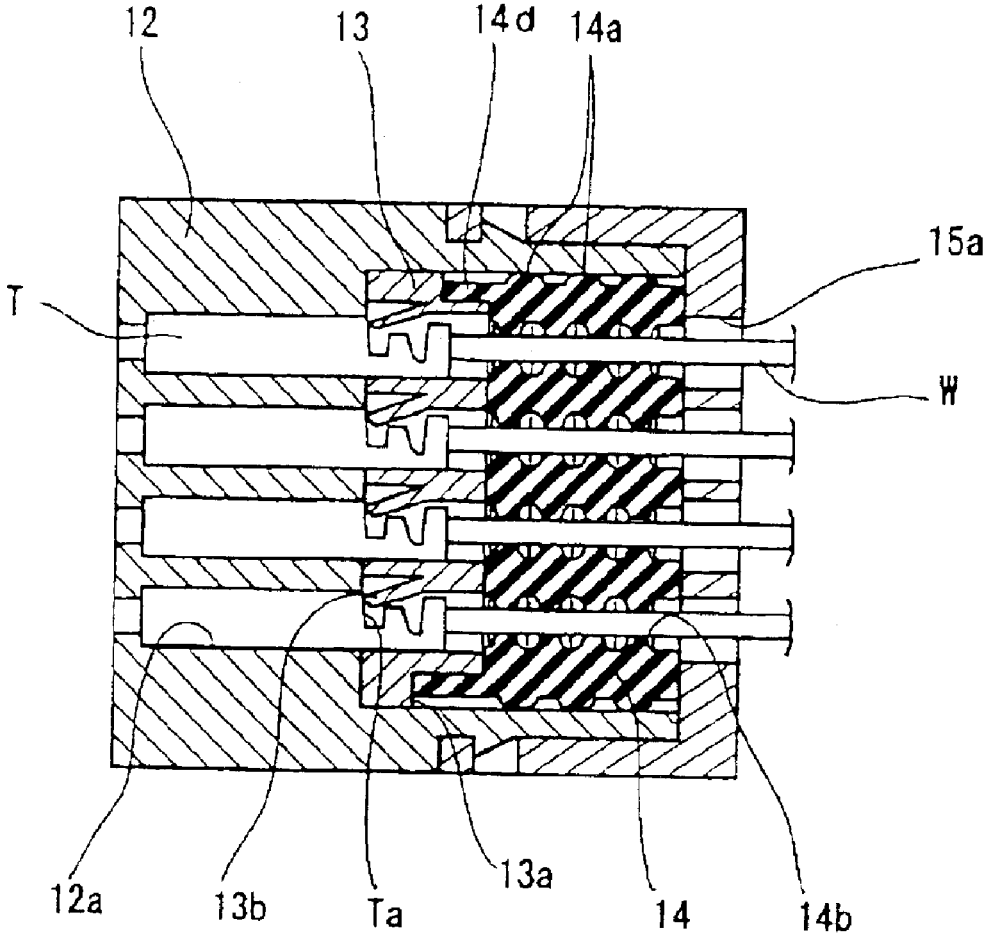
FIG. 19 is a cross section of the wire terminals completely inserted in the terminal chambers, according to the fifth embodiment.
Figure 20A:
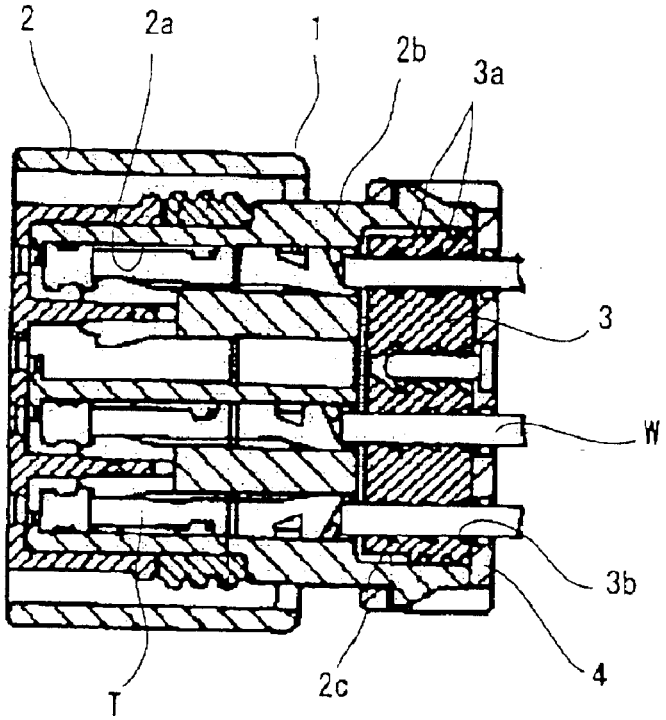
FIG.20A Prior Art
FIG. 20A is a cross section of a conventional waterproof electrical connector.
Figure 20B:
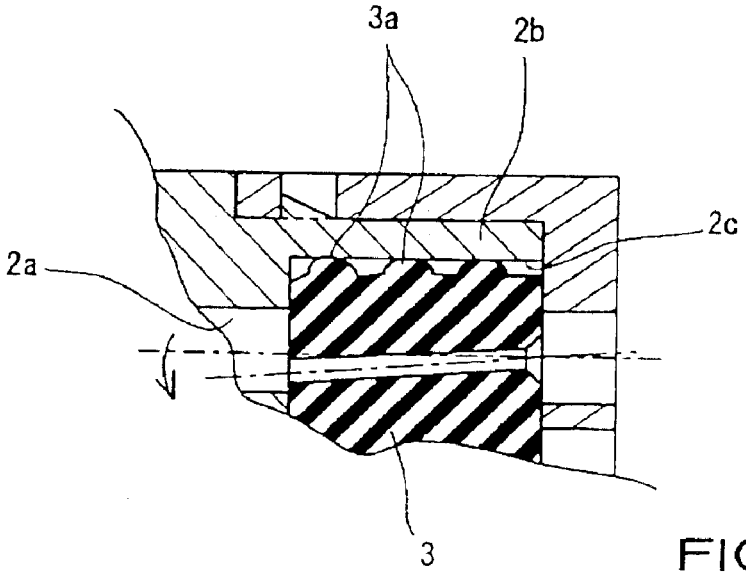
FIG.20B Prior Art
FIG. 20B is a detailed cross section of the part of the conventional waterproof electrical connector showing the shortcoming thereof.

Next, as shown in FIG. 19, wire terminal T (which is attached to the end of wire W) is inserted into thru-hole 15*c* in rear cover 15. Continued insertion results in wire terminal T pushing open thru-hole 14*b* in flexible plug 14, passing through thru-hole 13*a* in inner housing 13, and entering terminal chamber 12*a*. Wire terminal T is able to enter terminal chamber 12*a* smoothly without obstruction because the passage leading to terminal chamber 12*a* is straight due to the concentric alignment maintained between thru-holes 13*a*, 14*b*, and 15*c*. Once wire terminal T is completely inserted to terminal chamber 12*a*, lock tab 13*b* on inner housing 13 engages with stop edge Ta on wire terminal T to secure wire terminal T within terminal chamber 12*a*. At the same time, the constrictive pressure applied to wire W by the wall of thru-hole 14*b* forms a waterproof seal therebetween.

While this fifth embodiment describes inner housing 13 and flexible plug 14 being initially assembled and then inserted into internal space 12*d* of base housing 12, inner housing 13 may first be inserted into internal space 12*d*, and then flexible plug 14 may be joined to inner housing 13.

While all of the embodiments have described flexible plug 14 (24, 34) and rear cover 15 (25, 35) as double-molded to form an integrated structure exhibiting two different material properties, flexible plug 14 (24, 34) and rear cover 15 (25, 35) may be initially formed as separate components that are then mutually joined by using an adhesive or latch engagement. In addition, while the embodiments describe wire terminal T as a female-type connector terminal, wire terminal T may also be structured as a male-type wire terminal.

As described in the above explanation, the waterproof electrical connector according to the present invention incorporates a continuous channel formed into the insertion face of the flexible plug and located between the outermost thru-holes and the perimeter surface of the flexible plug. According to this structure, the channel is able to absorb the compression generated on the outer circumferential part of the flexible plug when the flexible plug is inserted into the internal space within the base housing.

The waterproof electrical connector according to the present invention further provides a structure in which the outwardly curved axes of the outermost thru-holes in the flexible plug, or the inclined wall parts of the thru-holes, are able to absorb pressure applied to the perimeter of the flexible plug when the flexible plug is inserted into the inner space of the base housing, because those inclined axes or the inclined wall parts are designed based on the prediction of displacement of those outermost thru-holes.

The waterproof electrical connector according to the present invention further incorporates a distortion suppressing flange extending from the perimeter of the inserting side of the flexible plug in the inserting direction. The inner surface of the distortion suppressing flange fits over a ledge formed around the perimeter of an end of the inner housing, thus preventing the distortion of the flexible plug when the perimeter of the flexible plug is constricted through its insertion into the internal space in the base housing.

As a result, the positional displacement of the thru-holes within the flexible plug is prevented, thus allowing the wire connector terminals on the wire ends to be easily and smoothly inserted through the flexible plug and into the terminal chambers.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Applications No. 2002-323400 and 2002-324314, both filed on Nov. 7, 2002, Japanese Patent Application No. 2002-325202 filed on Nov. 8, 2002, the entire contents of which is expressly incorporated by reference herein.

What is claimed is:

1. A waterproof electrical connector, comprising:

a base housing having a plurality of terminal chambers and an internal space defined by a perimeter wall located behind the plurality of terminal chambers;

a rear cover configured to engage with the base housing to seal the internal space, the rear cover having a plurality of thru-holes;

a flexible plug that extends from an inner surface of the rear cover, the flexible plug being configured to be inserted into the internal space, and including ribs formed on an outer peripheral surface of the flexible plug;

the flexible plug having a plurality of thru-holes, the rear cover thru-holes and the flexible plug thru-holes being configured to concentrically align with the plurality of terminal chambers; and the flexible plug having a channel formed on an inserting surface of the flexible plug, the channel being located between outermost flexible plug thru-holes and the outer peripheral surface of the flexible plug.

2. The waterproof electrical connector according to claim 1, wherein the channel is formed as a continuous loop.

3. The waterproof electrical connector according to claim 1, further comprising an inner housing that is installed within the internal space, the inner housing having a plurality of thru-holes that concentrically align with the plurality of terminal chambers, the plurality of flexible plug thru-holes and the plurality of rear cover thru-holes.

4. The waterproof electrical connector according to claim 3, further comprising a first engaging portion provided in at least one of the plurality of inner housing thru-holes, the first engaging portion being configured to engage with a second engaging portion provided on a wire terminal attached to an end of an electrical wire when the wire terminal is inserted into the terminal chamber.

5. The waterproof electrical connector according to claim 1, wherein the flexible plug is made from a resilient elastomer and the rear cover is made from a hard synthetic resin, the flexible plug and the rear cover being integrated as a single piece by double-molding.

6. A waterproof electrical connector, comprising:

a base housing having a plurality of terminal chambers and an internal space defined by a perimeter wall located behind the plurality of terminal chambers;

a rear cover configured to engage with the base housing to seal the internal space, the rear cover having a plurality of thru-holes;

a flexible plug that extends from an inner surface of the rear cover, the flexible plug being configured to be inserted into the internal space, and including ribs formed on an outer peripheral surface of the flexible plug; and the flexible plug having a plurality of thru-holes, the rear cover thru-holes and the flexible plug thru-holes being configured to concentrically align with the plurality of terminal chambers;

wherein the flexible plug is configured such that upon insertion of the flexible plug within the base housing, the plurality of flexible plug thru-holes remain substantially concentrically aligned with the plurality of terminal chambers despite constrictive pressure applied by the perimeter wall to the flexible plug upon insertions, wherein the flexible plug has a channel formed on an inserting surface of the flexible plug, and the channel is located between outermost flexible plug thru-holes and the outer peripheral surface of the flexible plug so that the channel is closed upon insertion of the flexible plug within the base housing to absorb the constrictive pressure applied by the perimeter wall to the flexible plug upon insertion.

* * * * *